US006111236A

United States Patent [19]

Storm et al.

[11] Patent Number: 6,111,236

[45] Date of Patent: Aug. 29, 2000

[54] INDUCTION HARDENING APPARATUS FOR A CRANKSHAFT

[75] Inventors: John M. Storm, Danville; Max E. Stewart, Plainfield; Spencer L. Gibbs, Danville, all of Ind.

[73] Assignee: Contour Hardening, Inc., Indianapolis, Ind.

[21] Appl. No.: 09/398,245

[22] Filed: Sep. 17, 1999

Related U.S. Application Data

[62] Division of application No. 08/959,799, Oct. 29, 1997, Pat. No. 6,018,155.

[51] Int. Cl.[7] ..... H05B 6/40

[52] U.S. Cl. ..... 219/639; 219/652

[58] Field of Search ..... 219/635–639, 219/640, 647–650, 652, 660–666, 672–677

[56] References Cited

U.S. PATENT DOCUMENTS

| | | | |
|---|---|---|---|
| 3,914,572 | 10/1975 | Jensen | 219/10.57 |
| 3,935,416 | 1/1976 | Cachat | 219/10.57 |
| 4,604,510 | 8/1986 | Laughlin et al. | 219/10.43 |
| 4,675,488 | 6/1987 | Mucha et al. | 219/10.43 |
| 4,714,809 | 12/1987 | Hammond et al. | 219/10.43 |
| 4,728,761 | 3/1988 | Mucha et al. | 219/10.43 |
| 4,757,170 | 7/1988 | Mucha et al. | 219/10.43 |
| 4,816,633 | 3/1989 | Mucha et al. | 219/10.41 |
| 4,855,556 | 8/1989 | Mucha et al. | 219/105.9 |
| 4,867,810 | 9/1989 | Novorsky | 148/150 |
| 4,893,789 | 1/1990 | Novorsky | 266/129 |
| 4,894,501 | 1/1990 | Pfaffmann et al. | 219/10.43 |
| 4,897,518 | 1/1990 | Mucha et al. | 219/10.41 |
| 5,157,231 | 10/1992 | Baeuerle et al. | 219/10.57 |
| 5,451,749 | 9/1995 | Griebel et al. | 219/639 |
| 5,796,078 | 8/1998 | Ottenwaelder et al. | 219/639 |
| 6,018,155 | 1/2000 | Storm et al. | 219/639 |

*Primary Examiner*—Tu Ba Hoang
*Attorney, Agent, or Firm*—Woodard, Emhardt, Naughton, Moriarty & McNett

[57] ABSTRACT

An induction hardening apparatus for inductively heating and quench hardening a crankshaft includes an arrangement of two workstations similarly configured and a robotic device indexing the crankshaft from a first workstation to a second workstation. The induction hardening apparatus is designed with a single induction coil located at the first workstation for the sequential induction heating and quench hardening of the pins of the crankshaft. At the second workstation, a single induction coil is used for the bearing surfaces of the crankshaft. An important feature of the present invention is that the induction coils do not contact the surfaces of the crankshaft which are being inductively heated and quench hardened. Crankshaft dimensions and geometry are programmed into servodrive systems which move the corresponding coil in X and Y directions accurately tracing the orbit or path of each pin and each bearing surface. Each induction coil is configured with openings on an inside surface in order to deliver a quench fluid directly to the inductively heated portion of the crankshaft.

15 Claims, 20 Drawing Sheets

INDUCTION HARDENING APPARATUS FOR A CRANKSHAFT

REFERENCE TO RELATED APPLICATION

This application is a divisional of patent application Ser. No. 08/959,799, filed Oct. 29, 1997, now U.S. Pat. No. 6,018,155.

BACKGROUND OF THE INVENTION

The present invention relates in general to methods and apparata for inductively heating and quench hardening a crankshaft. More specifically, the present invention relates to inductively heating and quench hardening a crankshaft, which may be oriented either horizontally or vertically, wherein the induction coil assembly (or assemblies) do not contact the surfaces of the crankshaft which are to be induction hardened. Computer controlled servomotors and X and Y drive systems are used to position and move the induction coil assembly relative to a crankpin portion of the crankshaft as the crankshaft rotates at a predetermined RPM. The travel of the induction coil assembly is based upon mathematical formulae and the crankshaft geometry, including crankshaft dimensions and the particular location of the crankpin portion to be induction hardened relative to the longitudinal axis of the crankshaft.

An automotive crankshaft is made up of a series of crankpins, one for each cylinder, in the case of in-line engines, or one for each pair of cylinders, in the case of V-type engines. The function of the crankshaft is to convert the reciprocating motion of the piston and its connecting rod into rotating motion. The throw of the crankshaft is equal to the stroke of the engine. The crankshaft needs to be properly balanced in order to eliminate centrifugal forces and accordingly the crankshaft is counterbalanced by weights placed opposite to the corresponding crankpins or just "pins". Each pin is received within one end of a corresponding connecting rod whose opposite end is pinned to a piston. Crankshafts are also configured with axial bearing surfaces which are designed for receipt by the main bearings. A six cylinder in-line crankshaft would typically have seven main bearings.

Due to the load and wear on the pins and on the bearing surfaces, the hardening of these portions of the crankshaft is important. One approach to this task is to inductively heat and then quench harden these critical surfaces. Traditionally the approach which has been followed is to place the crankshaft in a horizontal orientation and as the crankshaft reaches a substantially elevated temperature due to the induction heating, a support member is moved into position in order to support the crankshaft and keep it from sagging. This traditional approach also involves the induction coil and/or some portion of the induction coil assembly contacting and in fact actually riding on the surfaces which are to be inductively heated and quench hardened. This metal-to-metal contact accelerates the wear on the coil assembly, necessitating that the coil assembly be replaced periodically. The need to replace the induction coil assembly represents not only an added cost factor but also down time to the induction hardening equipment.

By orienting the crankshaft horizontally, the contact by the induction coil assembly on the critical surfaces of the crankshaft is actually encouraged due to the convenience of letting the induction coil assembly "ride" on the pins and bearing surfaces as the crankshaft is rotated between centers. This traditional approach of having the induction coil assembly function like a follower does not require any separate drive system for the induction coil assembly since the critical surfaces are in contact with the coil assembly. However, direct contact between the coil assembly and the portion of the crankshaft to be induction hardened is seen as a substantial disadvantage, not only due to wear of the induction coil assembly and the horizontal mounting of the crankshaft, but for the additional reasons which are set forth below.

When the induction coil assembly contacts the pins and/or bearing surfaces, it is difficult to identify the wear condition of the coil assembly. By riding directly on the crankshaft surfaces, the contacting surface of the induction coil assembly is effectively hidden from view, thereby making it difficult to assess the level or degree of wear on the coil assembly. This in turn means that the induction coil assembly can be run too long and reach a point at which it arcs out and this typically ruins the part and ruins or damages the coil assembly. Contact between the coil assembly and the crankshaft often results in marring or galling of the crankshaft surface and this requires extra grind stock which can then be machined away in order to grind out the surface imperfections. An extended post-hardening step is then required.

It would be a substantial improvement to the present methods and apparata for induction hardening crankshafts if an apparatus could be provided whereby the induction coil assembly does not have to contact the pins and bearing surfaces. Such an apparatus would significantly improve coil assembly life. It is also felt that being able to orient the crankshaft vertically would be advantageous. While the prior art does not envision any suitable solution to the problems which have been identified, the present invention provides an improved method and apparatus which achieves both improvements.

According to the present invention, the crankshaft which is to be induction hardened can be vertically oriented, even though the present invention still works quite well if the crankshaft is oriented horizontally. Further, one induction coil assembly is provided for the crankshaft pins and is located and operated at a first workstation. Either a separate induction coil assembly or a series of assemblies are provided for the bearing surfaces and are located and operated at a second workstation. These coil assemblies are designed such that there is no contact with the crankshaft surfaces which the coil assemblies are to induction harden. This improves the coil assembly life. According to the present invention, the dimensions and geometry of the crankshaft are used to define the path or orbit of each pin and the tracking path for each induction coil assembly is computed and programmed into suitable drive systems which control the travel of each coil assembly. While the bearing surfaces also have an orbit, these orbits are concentric with the axis of rotation of the crankshaft. Accordingly the coil assembly (or assemblies) used for these bearing surfaces does not have to travel in a matching orbit, but instead is stationary. Alternate embodiments of the present invention provide design variations to account for the presence of counterweights or for the presence of any other factor which could affect the balance of mass (heat balance) adjacent the pins of the crankshaft.

While there are other designs which suggest a vertical orientation for the workpiece, these other designs are limited to camshafts, not crankshafts. There are numerous differences between these two types of drive components, several of which suggest that technology directed to camshafts has very little relevancy to the present invention and the issues which are addressed and solved by the present invention.

For example, the individual cams of a camshaft are axially mounted and the protruding portion of the cam geometry is dimensionally fairly minor. There simply is not the off-axis dimensional shift for cams the way there is for the pins of a crankshaft. This results in a pin orbit of substantial size and travel relative to whatever cam orbit might be present. In turn, this results in substantially different challenges and problems for the design of a suitable induction coil tracking apparatus, with the crankshaft presenting the more challenging design task.

With regard to the comparison between a crankshaft and a camshaft, the profile of a crankpin is symmetrical and requires a uniform case depth. A cam of a camshaft is not symmetrical and does not require a uniform case depth. Accordingly, the induction coil assembly does not have to follow a cam and the cam can be induction hardened without having to move the coil assembly in a matching orbit. The desired case depth patterns for the cams can be achieved without displacement of the induction coil assembly. The lower loads placed on a cam mean that the required hardness depth can be less than that of a crankshaft pin, causing less demanding induction hardening. While the present invention can be used for a camshaft, there is no reason to do so.

Another feature addressed by the present invention is the arrangement of the handling equipment and the cooperating workstations. In order to provide handling efficiencies, the present invention is configured with multiple workstations for the loading, induction hardening, and unloading of the workpiece in sequential action.

One workstation is configured for induction hardening of the crankshaft pins. Another workstation is configured for induction hardening of the bearing surfaces. These two workstations may be arranged in either order since the pins and bearing surfaces can be induction hardened in any order. Since the bearing surfaces are coaxial with the centers supporting the crankshaft, the induction coil assembly for the bearing surfaces operates in an orbit which is coincident with the axis of rotation (longitudinal axis of the crankshaft). In contrast, the pins which are sequentially induction hardened, typically one pin at a time, are not located on-axis and have a different circumferential location, one pin to the next, relative to the position of the crankshaft.

While induction hardening of crankshafts is known and while the vertical orientation of camshafts is known, the present invention remains novel and unobvious. The combination of structural features of the present invention provides significant advantages to what presently exists and the long felt and heretofore unsatisfied need for the present invention validates its novel and unobvious advance in the art.

SUMMARY OF THE INVENTION

An induction hardening apparatus for inductively heating and quench hardening a crankshaft according to one embodiment of the present invention comprises a fixture for positioning and supporting a crankshaft at a crankshaft location, a rotary drive for rotating the crankshaft, an induction hardening station positioned adjacent the crankshaft location and including an induction coil assembly and a positioning system for moving the induction coil assembly in a predetermined path, a control for generating coil path data based upon the geometry and dimensions of a portion of the crankshaft to be induction hardened, the control being operatively connected to the positioning system and the portion of the crankshaft being moved in an orbital path during crankshaft rotation wherein the predetermined path generated by the positioning system tracks the orbital path such that the spacing between the induction coil assembly and the crankshaft portion during rotation of the crankshaft remain substantially uniform, the induction coil assembly being moved so as to be free of any contact with the crankshaft portion.

One object of the present invention is to provide an improved induction hardening apparatus for a crankshaft.

Related objects and advantages of the present invention will be apparent from the following description.

DESCRIPTION OF THE PREFERRED EMBODIMENT

Figure 1:
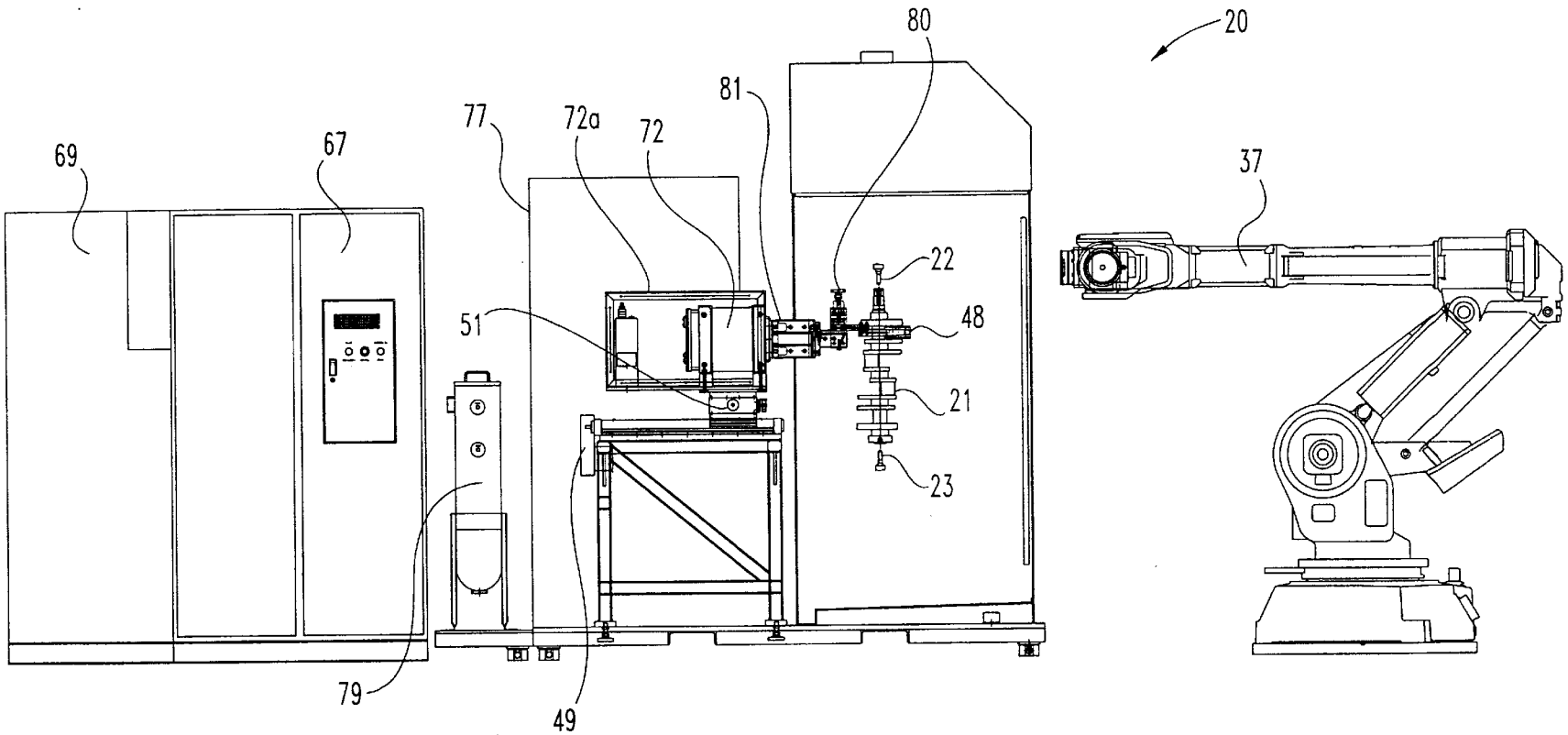
FIG. 1 is a side elevational view of an induction hardening apparatus for the pins of a crankshaft according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 5:
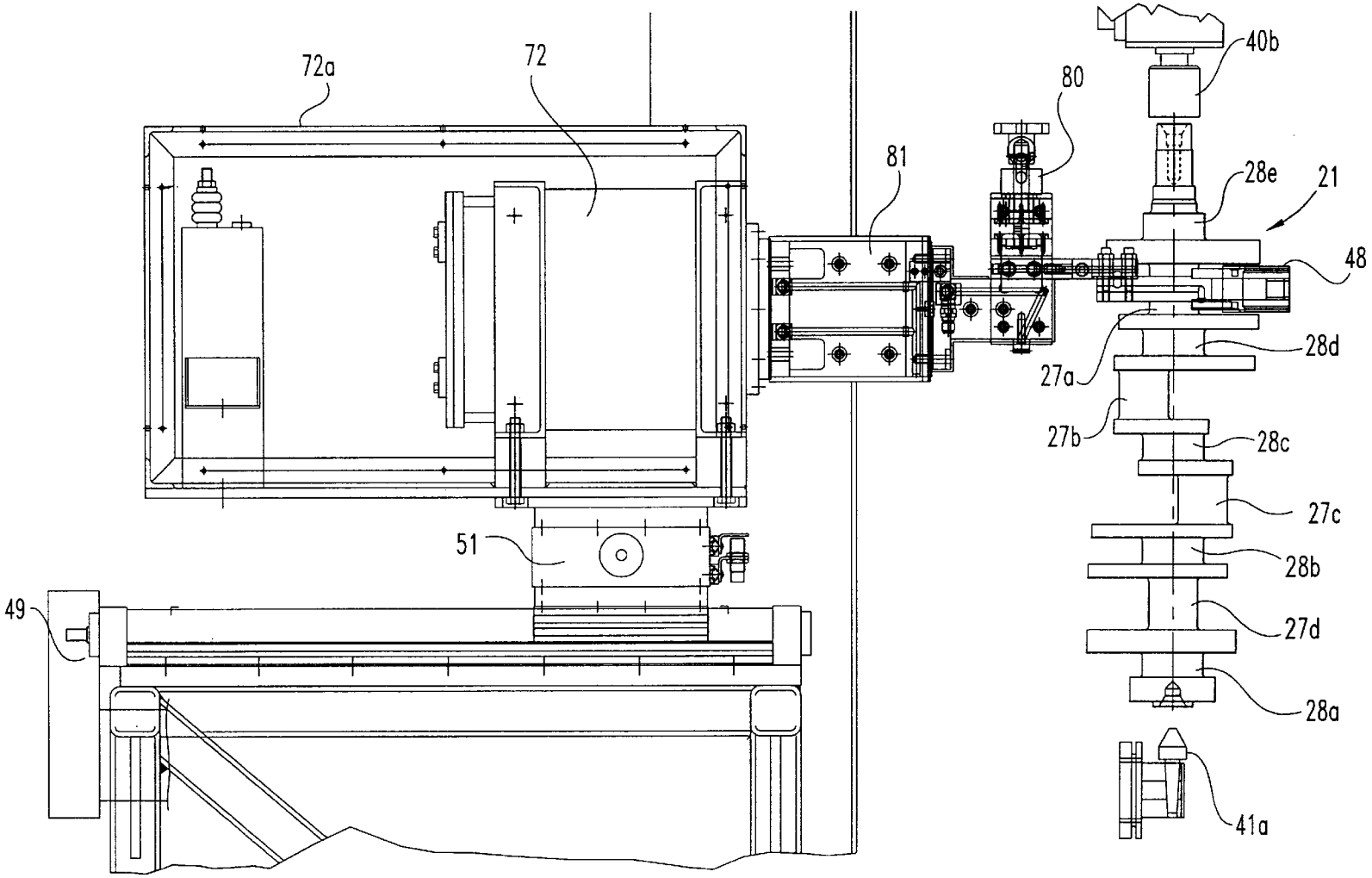
FIG. 5 is an enlarged side elevational view of the crankshaft to be induction hardened by the FIG. 1 induction hardening apparatus, including portions of the coil drive system.

Referring to FIGS. 1, 2, 3, 4, 5, 6, and 6A, there is illustrated an induction hardening apparatus 20 which is constructed and arranged for inductively heating and quench hardening a crankshaft 21. Crankshaft 21 is positioned in a vertical orientation and supported between centers 22 and 23. The illustration of the upper center 22 should be regarded as merely diagrammatic for the purpose of representing a true vertical orientation for the crankshaft. In actual practice when the pins of the crankshaft are being induction hardened, a positive lock (chuck) is required and is used. This is illustrated in FIG. 5. This fixturing of the crankshaft permits the use of a cooperating rotary drive mechanism in order to rotatably spin the crankshaft, on axis, between the positive lock (chuck) and lower center 23. Although the crankshaft 21 in FIGS. 1 and 5 is illustrated in a vertical mounting orientation between vertical centers, the present invention is equally suitable for a crankshaft which is positioned in a substantially horizontal orientation between horizontal centers.

With continued reference to FIG. 5, the details of crankshaft 21 are illustrated. The crankshaft used for an explanation of the present invention includes four cylinder (crank) pins 27*a*–27*d* and five cylindrical bearing surfaces 28*a*–28*e*. As would be known to one of ordinary skill in the crankshaft art, balance weights are disposed in cooperative relation to each pin in order to counterbalance the pin rotation and preferably eliminate any net centrifugal force. The pins 27*a*–27*d* and bearing surfaces 28*a*–28*e* are arranged in alternating sequence and represent critical wear surfaces which need to be hardened and the preferred method is by inductively heating and quench hardening these critical portions of the crankshaft. This is the role of apparatus 20 which is constructed and arranged to sequentially position an induction coil assembly adjacent each pin 27*a*–27*d* and perform the required heat treating steps. The bearing surfaces 28*a*–28*e* are inductively heated and quench hardened at another workstation which in one embodiment of the present invention comprises another portion of apparatus 20. In one embodiment of the present invention (see FIG. 6A), the water quench capability is built into the induction coil assemblies which are used for the pins and bearing surfaces. In another embodiment, the quench step is performed by a separate quench station which is not built into the coil assembly.

According to the present invention there are actually three primary configurations for apparatus 20 with a secondary variable for each primary configuration. In the illustrations of FIGS. 1–4, apparatus 20 includes two virtually identical workstations, both of which are designed for the induction hardening of pins. This configuration permits two crankshafts to be induction hardened simultaneously, in a side-by-side arrangement. A second apparatus 30 (see FIGS. 8–11) is provided for the induction hardening of the bearing surfaces of the crankshaft. The apparatus 30 used for the bearing surfaces may be used prior to the use of apparatus 20 or subsequent to the use of apparatus 20. The sequence of induction hardening as between the pins and the bearing surfaces is not critical. However, if multiple bearing surfaces are induction hardened simultaneously, a post grinding operation may be desired in order to eliminate any minor distortion and bring the crankshaft back into tolerance. Apparatus 30 is constructed and arranged with two virtually identical workstations, like apparatus 20, and thus two crankshafts can be processed in a side-by-side manner at the same time.

A second primary configuration of the present invention includes a design for apparatus 20 which includes only one (1) workstation which is constructed and arranged for the induction hardening of pins. In a similar fashion, apparatus 30 is constructed and arranged with only one workstation for the induction hardening of the bearing surfaces. These two single-workstation apparata may be used in any order and need not be used in close time proximity to one another. Conceivably, as a minor modification to this second primary configuration, it is envisioned that one apparatus would be arranged with a plurality of workstations and the other apparatus would be arranged with only one workstation.

The third primary configuration of the present invention includes a design for apparatus 20 where there are two workstations, but where one workstation is used for the pins of the crankshaft and the other workstation is used for the bearing surfaces of the crankshaft. This side-by-side arrangement of two workstations where each one is dedicated to a different portion of the crankshaft may be advantageous in smaller shops with more limited runs.

Figure 14A:
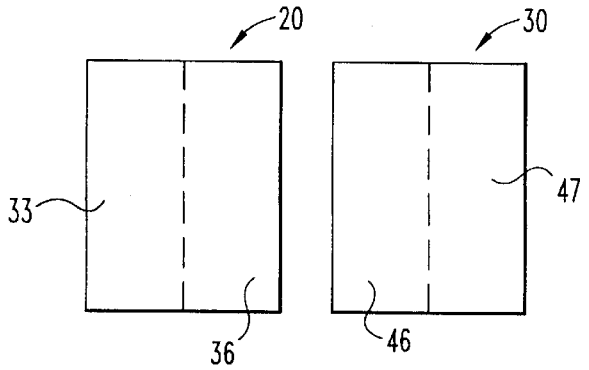
FIG. 14A is a diagrammatic illustration of one option for arranging the workstations of the present invention.
Figure 14B:
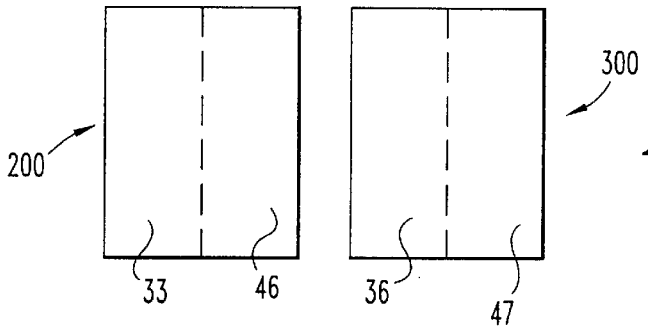
FIG. 14B is a diagrammatic illustration of another option for arranging the workstations of the present invention.
Figure 14C:
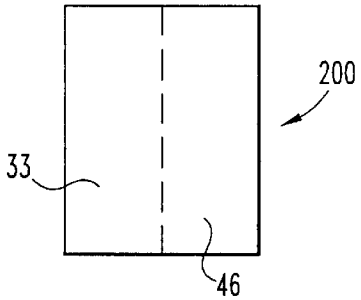
FIG. 14C is a diagrammatic illustration of another option for arranging the workstations of the present invention.

There are several apparatus and workstation combinations for the present invention and while some of the combinations have been mentioned, additional combinations are illustrated in FIGS. 14A–14E. As a partial recap of the foregoing descriptions, FIG. 14A diagrammatically illustrates two apparata 20 and 30 each with two workstations 33 and 36 and 46 and 47, respectively. Workstations 33 and 36 are constructed and arranged for induction hardening the pins of the crankshaft. Workstations 46 and 47 are constructed and arranged for induction hardening the bearing surfaces of the crankshaft. FIG. 14B diagrammatically illustrates the use of two virtually identical apparata 200 and 300. Each apparatus includes a pin workstation (33, 36) and a bearing surface workstation (46, 47). In FIG. 14C a single apparatus 200 is used and thus it should be understood that the number of apparata can be varied, the number of workstations at each apparatus can be varied, and the particular style of workstation at each apparatus can be varied.

Figure 13:
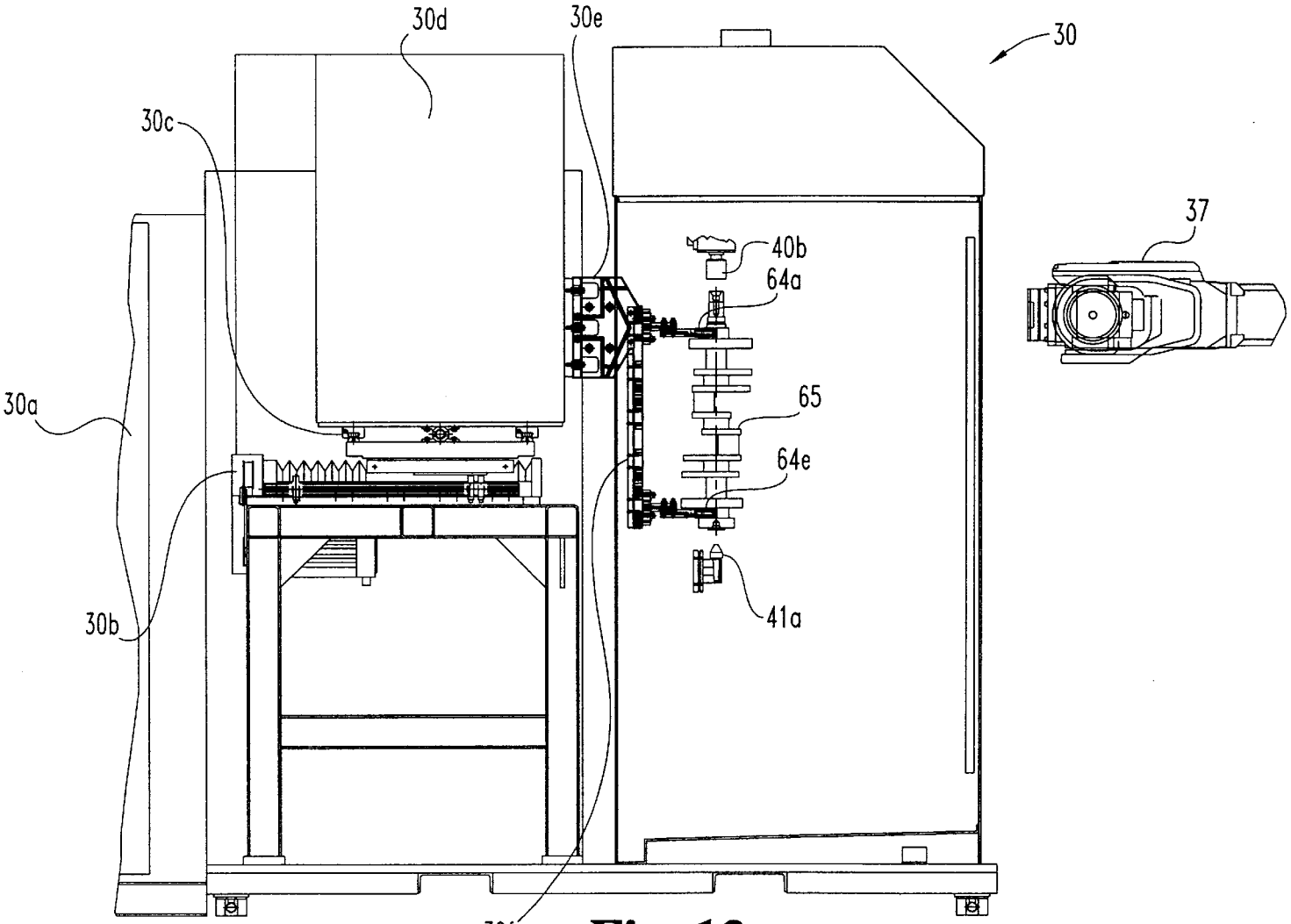
FIG. 13 is an enlarged side elevational view of the crankshaft to be induction hardened by the FIG. 8 induction hardening apparatus.
Figure 14D:
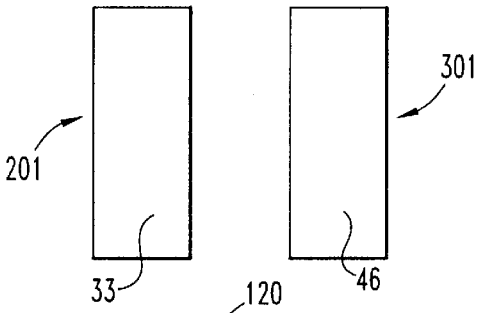
FIG. 14D is a diagrammatic illustration of another option for arranging the workstations of the present invention.
Figure 14E:
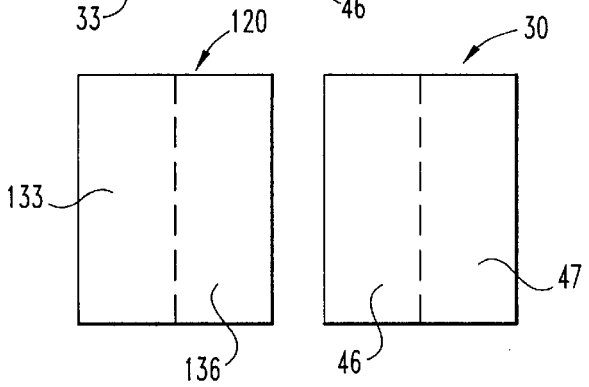
FIG. 14E is a diagrammatic illustration of another option for arranging the workstations of the present invention.

FIG. 14D diagrammatically illustrates two separate apparata 201 and 301, each of which include a single workstation, one workstation 33 for pins and the other workstation 46 for bearing surfaces. In FIG. 14E apparata 120 and 130 are diagrammatically illustrated and in this arrangement workstations 133 and 136 are constructed and arranged for the induction heating of two (or more) pins simultaneously. Apparatus 120 is illustrated in detail in FIGS. 2A and 3A but is mentioned here in order to cover a further variation of the present invention. It is also to be understood that workstations 46 and 47 are constructed and arranged to induction harden multiple bearing surfaces simultaneously, typically either two at a time or three at a time, see FIGS. 12 and 13. Further, it is to be understood that the plurality-of-pins workstations 133, 136 can be substituted for workstations 33 and/or 36, respectively, in any one of the FIGS. 14A–14D arrangements.

Figure 15:
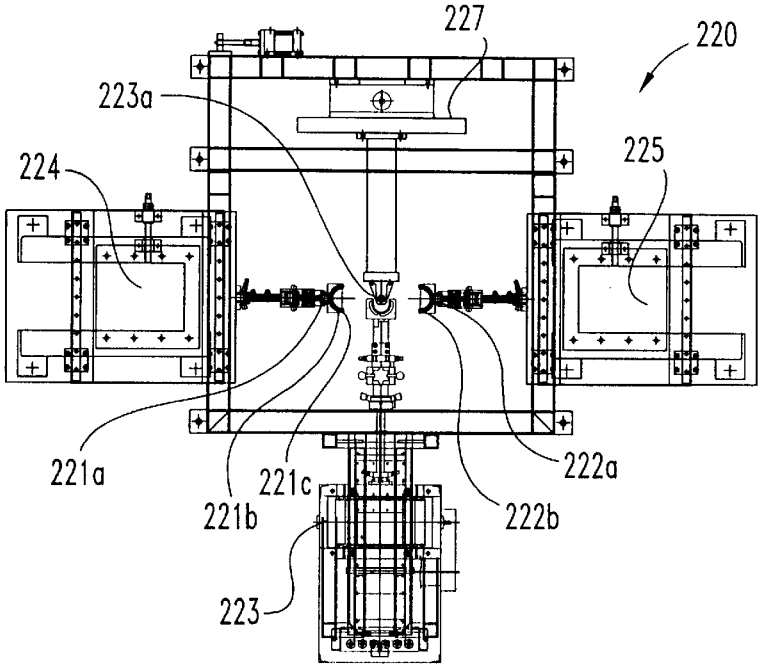
FIG. 15 is a diagrammatic top plan view of an induction hardening apparatus according to another embodiment of the present invention.
Figure 16:
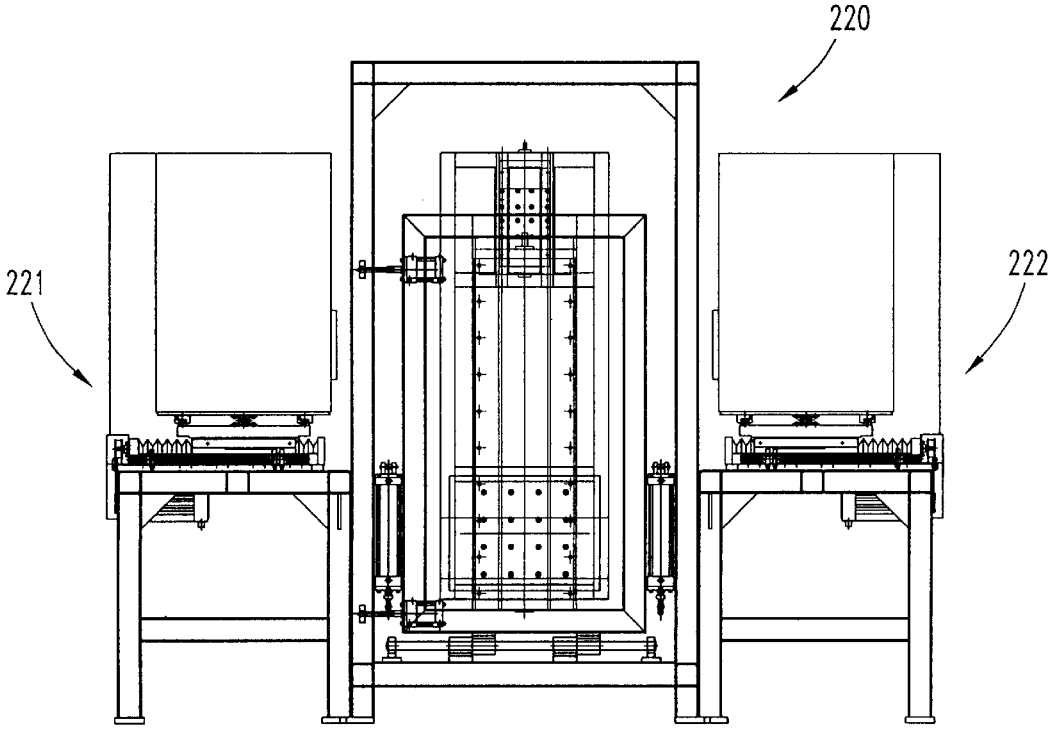
FIG. 16 is a diagrammatic front elevational view of the FIG. 15 induction hardening apparatus.
Figure 17:
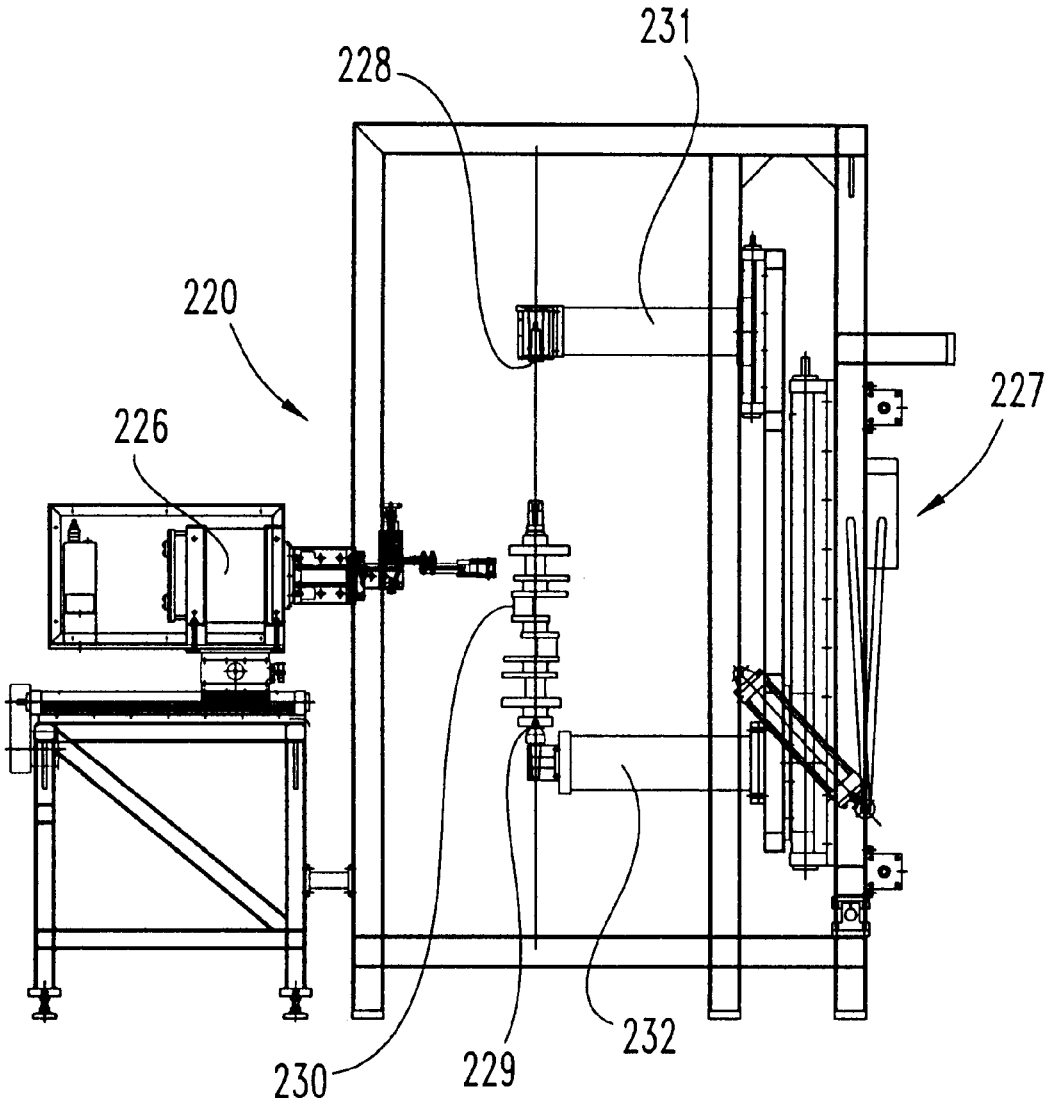
FIG. 17 is a diagrammatic side elevational view of the FIG. 15 induction hardening apparatus.

A further combination of features for the present invention is illustrated in FIGS. 15, 16, and 17 wherein a single workstation is constructed and arranged to induction harden both pins and bearing surfaces. A single coil assembly is used for the pins and two sets of coil assemblies are used for the bearing surfaces, similar to what is disclosed in FIGS. 12 and 13. There is a single vertical positioning system and, in effect, a single spindle which is common to all three series or sets of coil assemblies which are positioned by means of X-axis and Y-axis positioning mechanisms.

While one embodiment of the present invention is directed principally to the design of the induction coil assemblies and the drive systems which allow the coil assemblies to precisely track the orbit of each pin of the crankshaft workpiece, there are other design features of apparatus 20 which are of importance, including the associated equipment, positioning of the crankshaft workpiece, the design of the workstations, and the automated nature of the entire apparatus. Additional embodiments of the present invention provide variations as to the speed of rotation of the crankshaft and the rate of travel of the coil assembly during a single cycle (i.e., revolution), variations to the power supply output, and the shape of the path of travel of the coil assembly. What is important to understand with regard to the first embodiment of the present invention is that as the crankshaft is rotated in a vertical orientation on a lower center, each of the pins and each of the bearings generate a particular orbit or path of travel. When a coil assembly is positioned adjacent to a particular pin for inductively heating and quench hardening, the coil assembly is moved in an X/Y direction so as to track or trace the same orbit without contacting any portion of the crankshaft. In another, related embodiment of the present invention, the speed of rotation of the crankshaft and accordingly the speed of travel of the tracking coil assembly changes, accelerates and/or decelerates, during each cycle in order to accommodate or adjust for heat loss due to counterweights. In a still further embodiment of the present invention, the orbit or tracking path of the coil assembly is designed to change the spacing between the coil portion of the coil assembly and the crankshaft pin in order to adjust for heat loss due to the presence of the counterweights and thereby achieve a uniformity of case depth. The adjustment for counterweight heat loss can also be achieved by rapidly changing the kW output of the power supply. While reference has been made to the heat loss caused by the counterweights, the corresponding adjustments represented by the alternate embodiments can be practiced whenever there is a structure or any other reason which affects the balance of mass (heat balance) adjacent the pins (or pin) of the crankshaft.

Further, if the bearing surfaces which are coaxial with the longitudinal axis of rotation of the crankshaft include some type of heat sink or heat variable, then adjustments can be made to offset or compensate for any heat loss from that surface selected for induction hardening. If the corresponding induction coil remains stationary, the forms of heat loss adjustment for the bearing surfaces include a speed adjustment by accelerating and decelerating and a power output adjustment by varying the output power of the coil assembly, depending on the position of the heat sink or heat loss component or structure. The description of these two adjustments for the pins are depicted diagrammatically in FIG. 7A. When bearing surfaces are involved instead of pins, the coil assembly 63 is positioned around a corresponding bearing surface, such as bearing surface 28*a*. It is to be noted that coil assembly 48 is for the pins while coil assembly 63 is used for the bearing surfaces. With the coil assembly 63 so positioned, the speed adjustment and the power output adjustment are performed for the bearing surfaces in the same manner that these adjustments were performed for the pins.

If the induction coil assembly 63 is allowed to shift in the Y-axis direction (only), then the coil assembly positioning adjustment (see FIG. 7B), which is an option for the pins, can be used for the bearing surfaces. Here again, the coil assembly 63 is positioned around the bearing surface such as bearing surface 28*a* and the coil assembly moves in and out (Y-axis direction) in order to change the spacing between the inner surface of the coil portion and the bearing surface. The closer the inner surface is to the bearing surface, the greater the amount of heat which is generated in the bearing surface.

With continued reference to the first embodiment, by precisely entering dimensional and positional data into a servodrive system, the present invention moves the induction coil assembly in a way to maintain substantially uniform spacing between the inner surface of the coil assembly and the outer surface of the particular pin. Since the bearing surfaces are coaxial with the vertical centers, the "orbit" of each bearing surface is on-axis and all bearing surface orbits are the same. Accordingly, the induction coil assemblies of the present invention as well as the coil positioning systems are described as being "contact-free" because they do not contact the surfaces of the crankshaft which are to be induction hardened.

Figure 2:
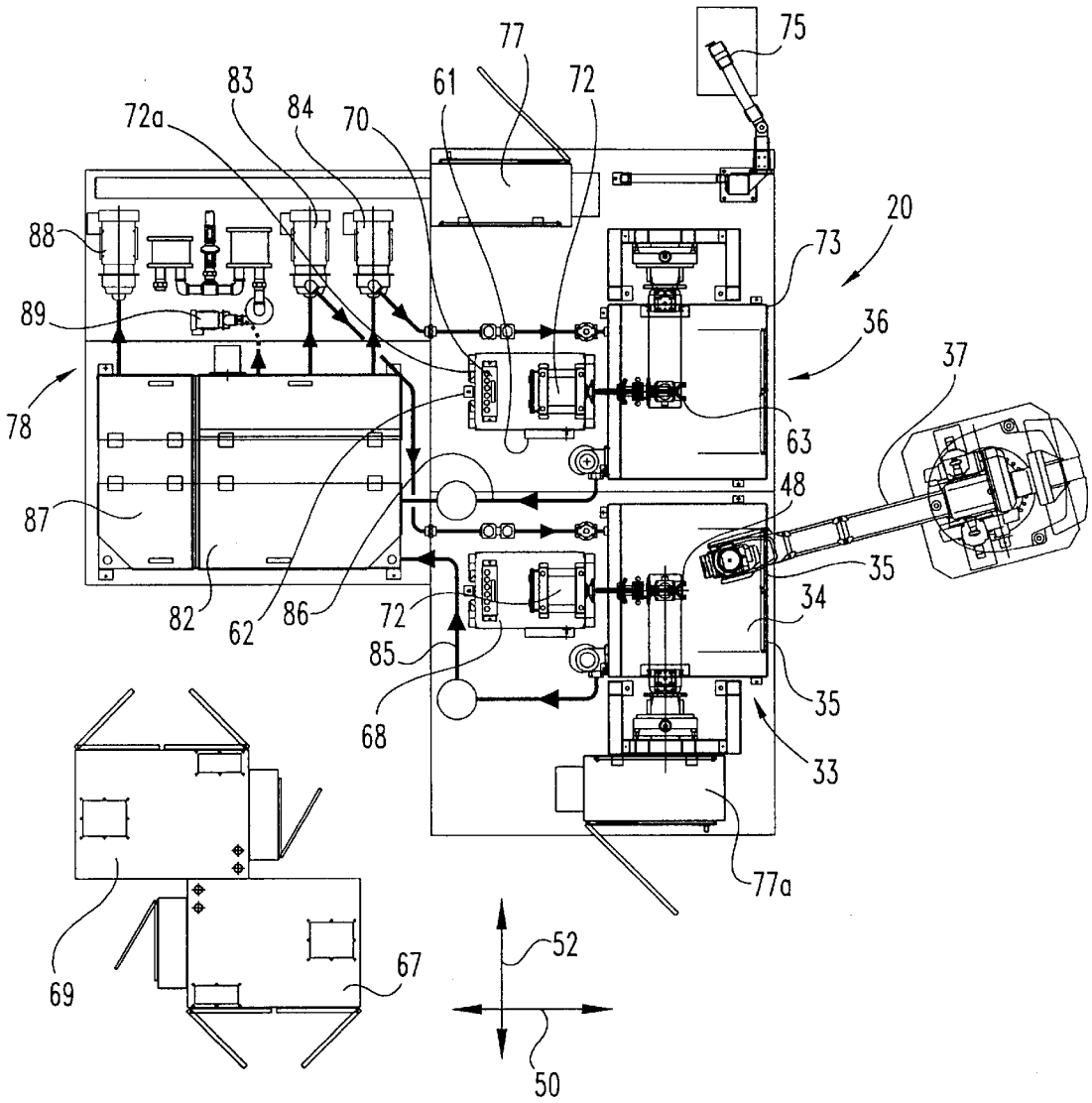
FIG. 2 is a top plan view of the FIG. 1 induction hardening apparatus.
Figure 3:
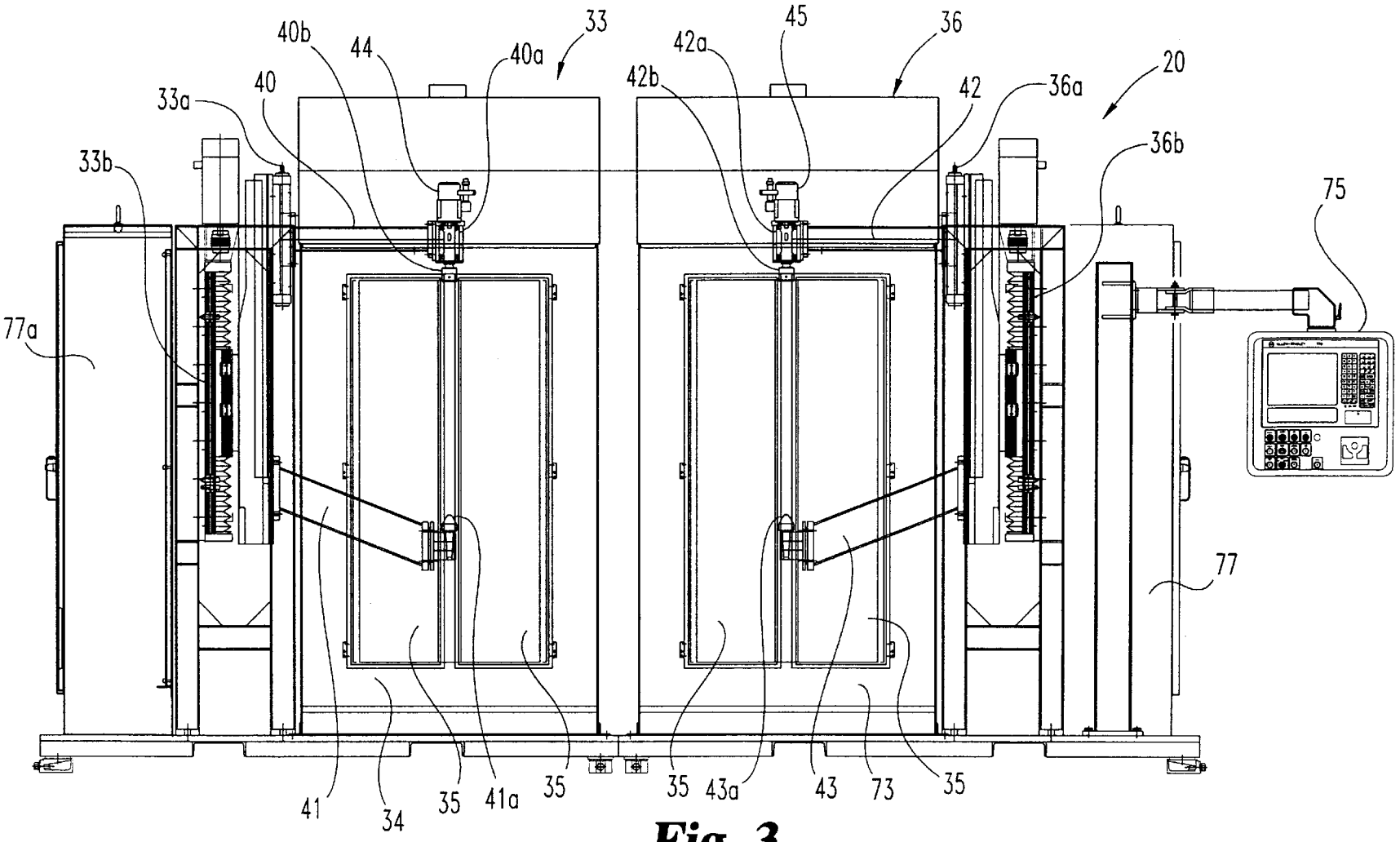
FIG. 3 is a front elevational view of the FIG. 1 induction hardening apparatus.

With regard to FIGS. 1, 2, 3, and 4, FIG. 2 is a complete top plan view of apparatus 20. The remaining figures each have some portion removed for drawing clarity. In FIG. 1, portions of the controls, frame, and drive spindle have been removed for drawing clarity. In FIG. 3, the crankshaft, system components, and robot have been removed for drawing clarity, while in FIG. 4, the human/machine interface (HMI) has been removed. Consequently, these four figures should be considered together as a complementing set.

Based on the illustrations of these drawing figures, induction hardening apparatus 20 includes a first workstation 33 located within an enclosure 34 with front-side access doors 35 and a second workstation 36 of a similar construction. The two workstations are illustrated with doors 35 closed, but with the arms, centers, drives and bearings illustrated. Therefore, FIG. 3 should be regarded as diagrammatic with regard to what it illustrates behind the closed doors 35. At the first workstation, the pins 27*a*–27*d* of a first crankshaft are inductively heated and quench hardened. In one embodiment a single coil is used and the pins are sequentially induction hardened. In a related embodiment, see FIGS. 2A and 3A, two pins are able to be induction hardened simultaneously. This requires the use of two coil assemblies and a design whereby pins 27*a* and 27*c* are induction hardened together and then subsequently pins 27*b* and 27*d* are induction hardened together (i.e., simultaneously).

At the second workstation 36, the pins of a second crankshaft are inductively heated and quench hardened. In essence the two workstations 33 and 36 are of virtually identical construction and are used concurrently to induction harden two separate crankshafts. The crankshafts at the two workstations have not been illustrated in FIG. 3 for drawing clarity. The two crankshafts which are induction hardened at the two workstations 33 and 36 are loaded and unloaded by means of robot 37. If a second apparatus 30 is present for the induction hardening of the bearing surfaces of the two crankshafts, then the crankshafts are also moved to the bearing surface apparatus 30 by a robot mechanism such as robot 37. At this second apparatus location, the bearing surfaces 28*a*–28*e* are inductively heated and quench hardened. When completed, the robot 37 removes the crankshafts and loads the next crankshafts into position at the first apparatus.

With continued reference to FIGS. 2 and 3, the processing of crankshaft 21 at workstation 33 will be described in detail. It should be understood that the structure of workstation 36 is virtually identical when induction hardening the pins of a second crankshaft. Crankshaft 21 is moved into position at workstation 33 of apparatus 20 and held in the desired vertical orientation by the robot arm until the support arms 40 and 41 at the first workstation 33 (and support arms 42 and 43 at the second workstation 36) take over the vertical positioning and support of the crankshaft 21. Each support arm 40–43 is automatically moved into position based upon programmable logic control circuitry which is used to preprogram the mechanical drive systems and servos associated with each support arm. Each lower support arm 41 and 43 is assembled with a centering spindle tip 41*a* and 43*a*, respectively, for insertion into a corresponding center socket in the end of the crankshaft which is loaded into position at the corresponding workstation. The upper support arms 40 and 42 are each assembled with a bearing housing 40*a* and 42*a*, respectively, and a cooperating chuck 40*b* and 42*b*, respectively, which is used to lock onto the upper end of the crankshaft. The fixturing of the crankshaft in this manner maintains a true vertical orientation and provides a true vertical axis for rotation of the crankshaft on its longitudinal centerline which is concentric with the geometric centerline axis of each cylindrical bearing surface 28*a*–28*e*.

While the axial position of each upper arm 40 and 42 during the steps of inductive heating and quench hardening is the same for each crankshaft, regardless of the size or length, lower arms 41 and 43 are moveable and can be axially shifted to different "run" positions in order to accommodate different crankshaft lengths. Mounted at the end of upper arm 40 is an electric current spindle motor 44 for rotatably spinning the crankshaft at a predetermined rate. A similar electric current spindle motor 45 is mounted at the end of upper arm 42 for spinning rotation at the second workstation. Spinning of the crankshaft is generally beneficial in order to make a uniform and balanced heating pattern in the workpiece, whatever portion might be the focus of the induction hardening. Spinning of the crankshaft is also beneficial for uniform quenching. Since the induction coil assembly used at each workstation of each apparatus as part of the present invention has an open, semicylindrical shape, it is essential that each crankshaft be rotated in order to get complete and uniform heating of the critical portions of the crankshaft. At the first apparatus 20, including both workstations 33 and 36, these critical portions are the pins 27*a*–27*d* . At the second apparatus 30, including both workstations 46 and 47, these critical portions are the bearing surfaces 28*a*–28*e*.

The following description regarding the first workstation 33 is virtually identical for the second workstation 36. Upper arm 40 is connected to a clamp cylinder 33*a* (cylinder 36*a* at workstation 36) which is used to clamp the corresponding crankshaft between chuck 40*b* and centering spindle tip 41*a*. The vertical movement of the chucked and centered crankshaft involves the vertical positioning portion 33*b* (portion 36*b* at workstation 36) which provides the Z-axis drive. This Z-axis drive is a ball screw servodrive and is used to shift the vertical position of the crankshaft when it is desired to move the crankshaft so that a different pin is positioned adjacent the corresponding induction coil assembly.

In one embodiment of the present invention a single induction coil assembly 48 is located at the first workstation 33 and is securely mounted to a Y-drive system 49 which is controlled by suitable servo circuitry, based upon part geometry and dimensions which are derived from the crankshaft drawings or from other part specifications. System 49 is constructed and arranged to move the induction coil assembly 48 in and out in the direction of arrow 50. Coil assembly 48 is also securely mounted to an X-drive system 51 which is controlled by servodrive circuitry and programmed in a manner similar to that utilized for the Y-drive system 49. System 51 is constructed and arranged to move the induction coil assembly 48 side-to-side in the direction of arrow 52.

The X and Y drive systems 51 and 49 each incorporate servo ball screw tables which actually position the induction coil assembly 48. These two tables are mechanically connected to each other with a ninety (90) degree or right angle relationship as would be understood and expected for X and Y drives. As explained, the crankshaft 21 is in effect mounted on centers 22 and 23 and rotated. In actual practice the upper center 22 takes the form of a chuck 40*b*. A servomotor (electric current spindle motor) 44 is used to drive the crankshaft and provides rotation data and pin position data to a computer control which is operably connected to the X and Y drive systems 51 and 49. Location data regarding the position of the corresponding pin 27*a* which is to be inductively heated and quench hardened is fed into the computer control which utilizes a data base program to move the induction coil assembly 48 in a tracking orbit which follows the particular orbit for the particular pin. The computer control program controls the X and Y drive systems and specifically the corresponding servo ball screw tables that position the coil assembly.

Each pin has a particular circumferential location relative to the longitudinal axis of the crankshaft 21. These pin locations coincide with the firing sequence for the cylinders of the engine. While the orbit of each pin is circular and while each orbit is of the same size, the actual location of a particular pin within its circular orbit at any instant of time depends on which pin is being considered and the corresponding cylinder. Accordingly, as the servomotor 44 provides positional data regarding the rotational status of the crankshaft, it is possible to compute a precise and corresponding pin location for each pin 27*a*–27*d* of the crankshaft, given that the pin dimensions and angularity are known from crankshaft part specifications and/or crankshaft blueprints or CAD drawings. With this data, it is thus possible to create a tracking orbital path for the induction coil assembly 48 relative to each pin.

Figure 7:
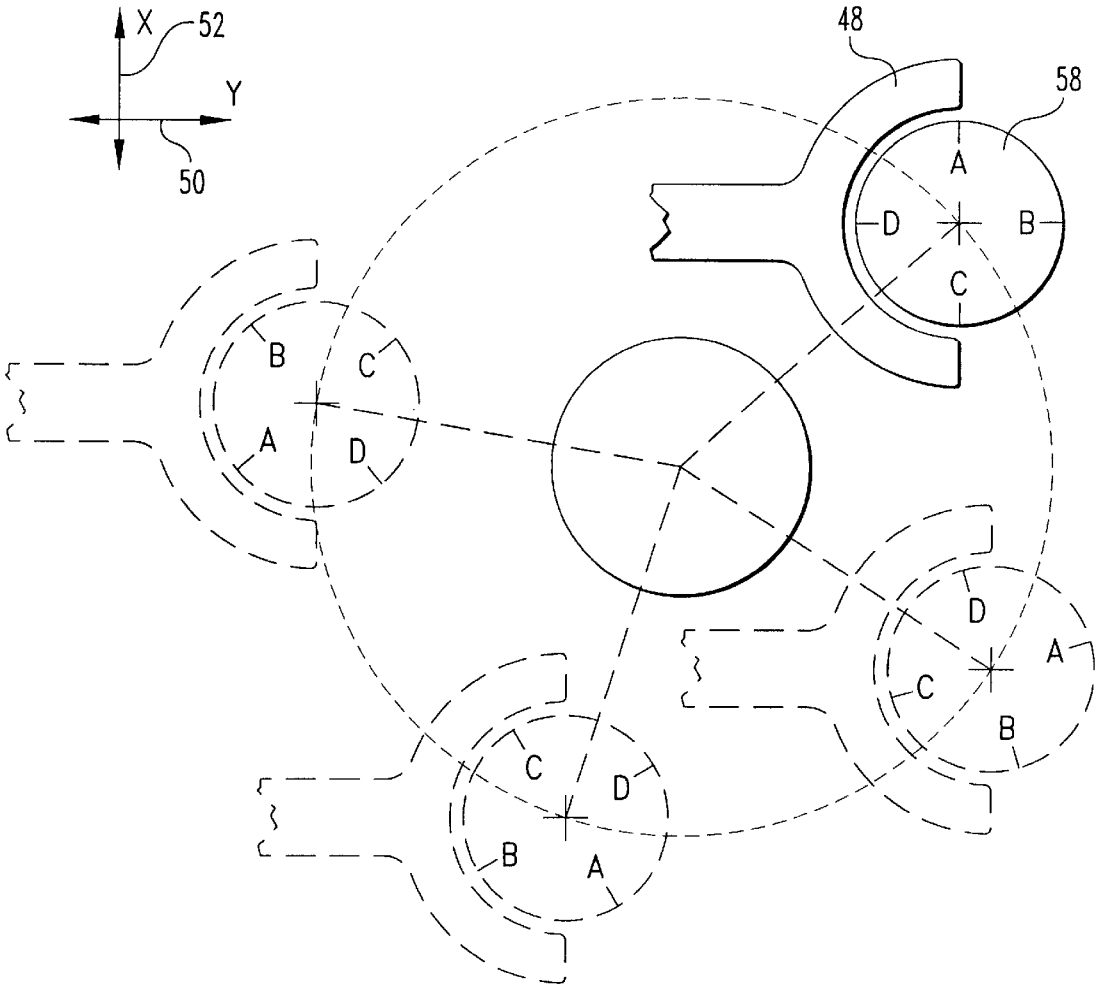
FIG. 7 is a diagrammatic illustration of the orientation of a crankshaft pin during one revolution of the crankshaft.

In the first embodiment of the present invention, the drive systems for the induction coil assembly are programmed to move the coil assembly in an orbit or track which precisely traces or copies the orbit path of the pin which is being induction hardened. This precise tracking by the coil assembly positions the semicylindrical inside surface of the coil portion at a fixed distance of separation (see FIG. 7) relative to the outside diameter surface of the pin.

Figure 6:
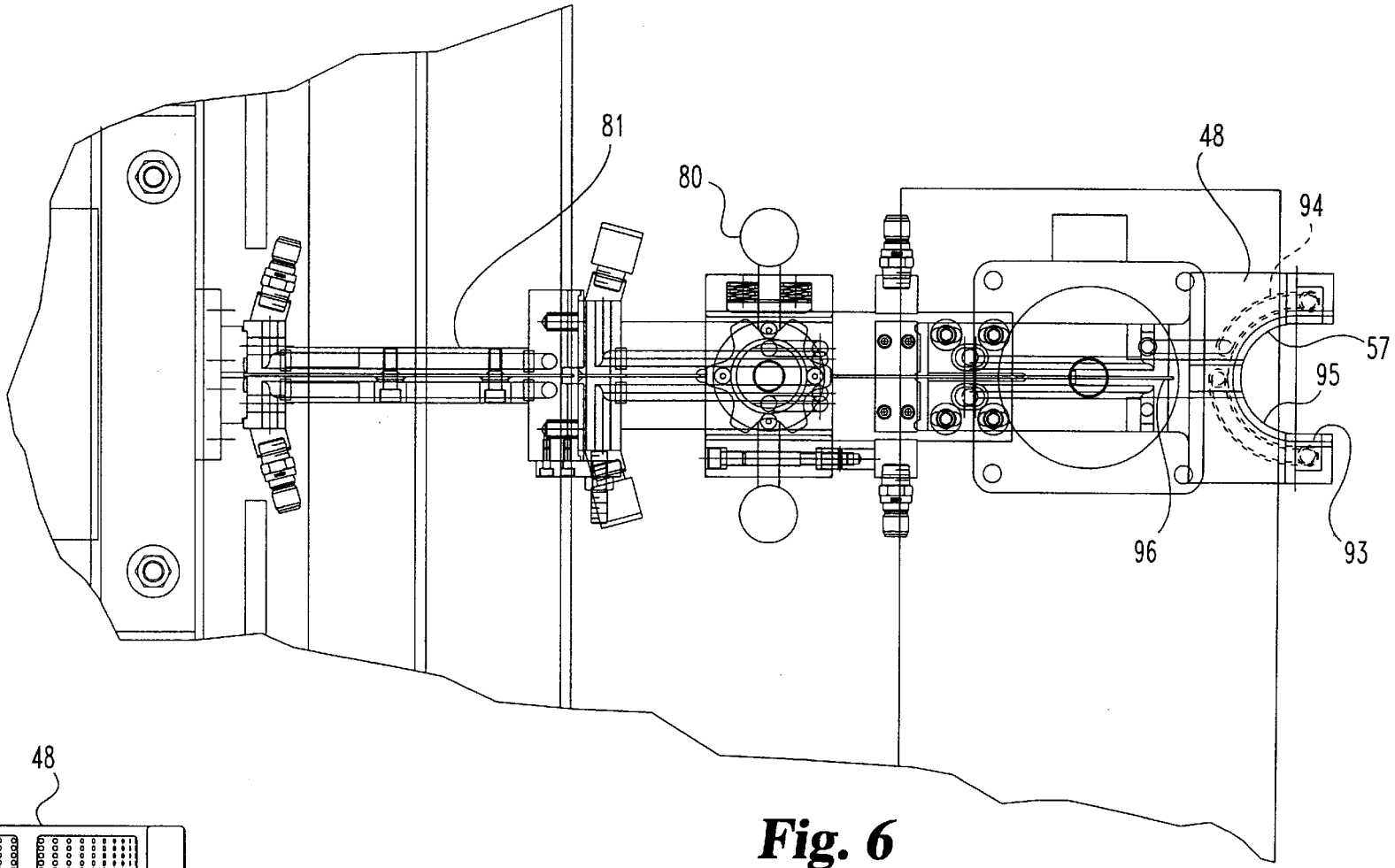
FIG. 6 is an enlarged top plan view of the induction coil at a first workstation comprising a portion of the FIG. 1 induction hardening apparatus.

According to the present invention, the induction coil portion of the coil assembly 48 has a part-circular, semicylindrical shape (see FIG. 6). The inner surface 57 is shaped so as to match the shape of each crankshaft pin, which is cylindrical. By creating coil assembly 48 with one side open, the coil is able to fit around a portion of each crankshaft pin. As the particular pin rotates with the crankshaft, its entire circumference ultimately is placed directly adjacent to the inner surface 57. This positional relationship is diagrammatically illustrated in FIG. 7. Four points A, B, C, and D, located ninety (90) degrees apart have been identified on the surface of cylindrical pin 58 in order to be able to show how these points shift relative to the X and Y directions for the induction coil assembly 48 as represented by arrows 52 and 50, respectively. The description of what occurs at the first workstation 33 of apparatus 20 is duplicated at the second workstation 36 of apparatus 20 when the second workstation is configured for induction hardening pins.

In those situations where counterweights are used and are connected adjacent the pins, there is a heat sink which draws heat away from the pin when the coil assembly is facing that portion of the pin which is closest to the counterweight. As would be understood for an induction hardening apparatus of the type described herein, the heated portion of the pin, or bearing surface, is localized and is that portion which is closest to the semicylindrical inner surface 57 of the coil portion. Consequently, when the coil portion is opposite to the counterweight, there is no noticeable heat sink loss which needs to be addressed by some form adjustment.

In the related embodiments of the present invention, the form of adjustment to compensate for heat loss takes three different forms. In one embodiment of the present invention (see FIG. 7A), the rotation of the crankshaft is varied (accelerate and/or decelerate) in each revolution so that there is a brief dwell or slowing of the rotation rate when the coil portion is adjacent the heat sink portion (i.e. counterweight 58*a*) of the pin. This dwell generates more heat which compensates for the heat which is lost due to the counterweights.

Figure 7A:
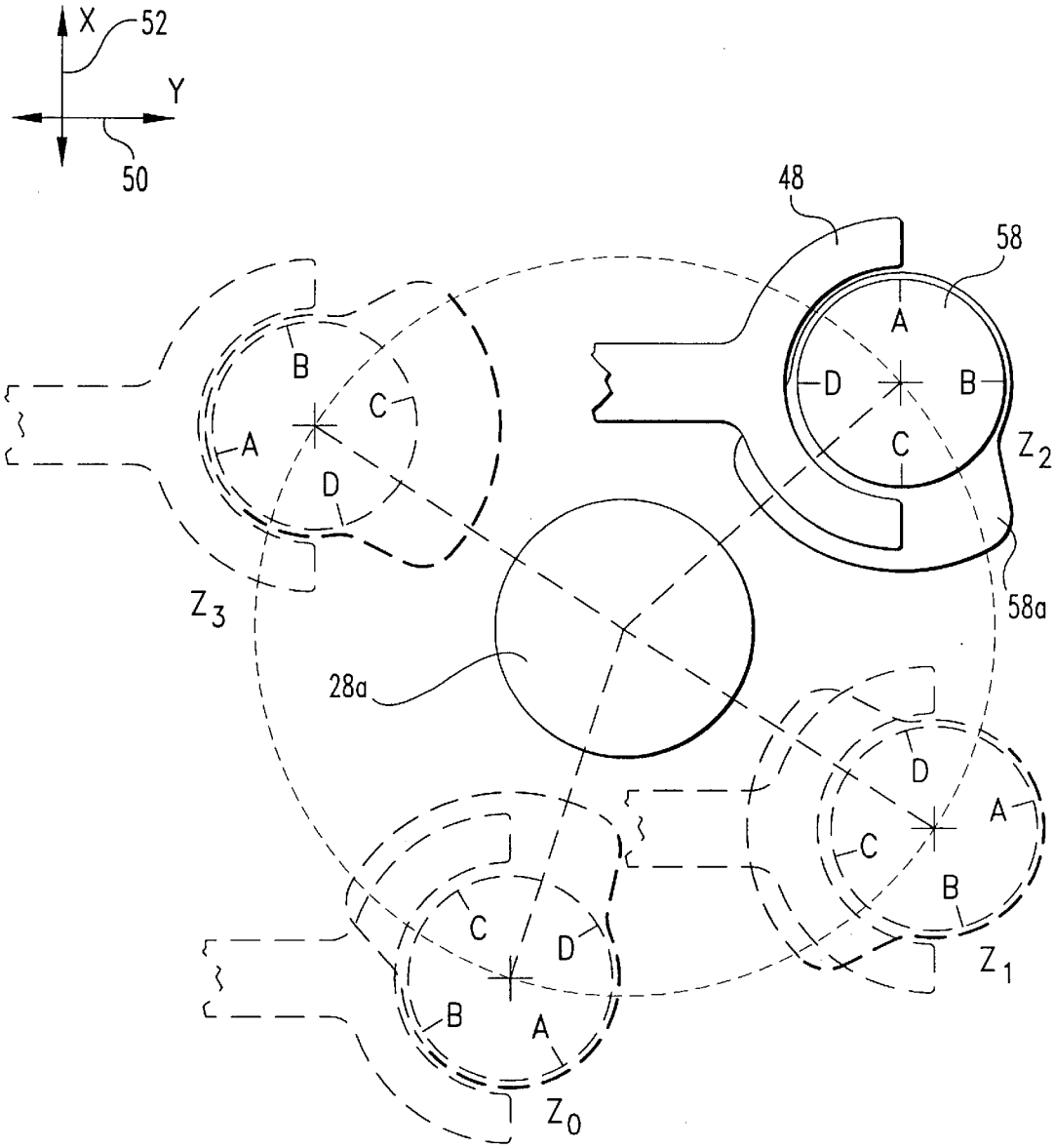
FIG. 7A is a diagrammatic illustration of the orientation of a crankshaft counterweight during one revolution of the crankshaft according to one embodiment of the present invention.

In the FIG. 7A drawing, the location of the counterweight 58*a* relative to coil assembly 48 is illustrated in four different positions ($Z_0$–$Z_3$) during one cycle which corresponds to one revolution of the crankshaft. As described the speed of rotation ($S_R$) of the crankshaft is varied depending on the counterweight location ($Z_N$) relative to the coil portion of the coil assembly. The coil assembly 48 is diagrammatically illustrated by a semicylindrical coil portion. In the $Z_1$ position, when the coil portion is effectively centered on the counterweight 58*a*, the speed of rotation ($S_{R1}$) will be the minimum of the entire cycle. This causes the coil portion to remain adjacent this portion of the pin for a longer interval so that more heat is input to the pin. When the coil portion and counterweight 58*a* are on opposite sides of the pin 58, the $Z_3$ position, the speed of rotation ($S_{R3}$) is at the maximum for the cycle (i.e., one revolution of the crankshaft). This means that the heating interval will be shorter which is appropriate since the counterweight 58*a* is not going to draw off any significant amount of heat from the pin. In between these two speed extremes, the speed of rotation accelerates and decelerates. The acceleration line from $Z_1$ to $Z_3$ coincides with the deceleration line from $Z_3$ to $Z_1$.

In another embodiment of the present invention, (see FIG. 7B), the coil assembly distance of separation relative to the pin surface is varied or changed slightly during each cycle (i.e., each revolution of the crankshaft). When the coil assembly is on the counterweight side of the pin, it is placed closer to the pin than when the counterweight is on the opposite side of the pin from the coil. By placing the coil portion closer, the heat generated by the coil assembly into the pin is greater at the closer distance. This approach requires that the X and Y drive systems for the coil assembly be controlled so as to sweep a path which is more elliptical than circular.

Figure 7B:
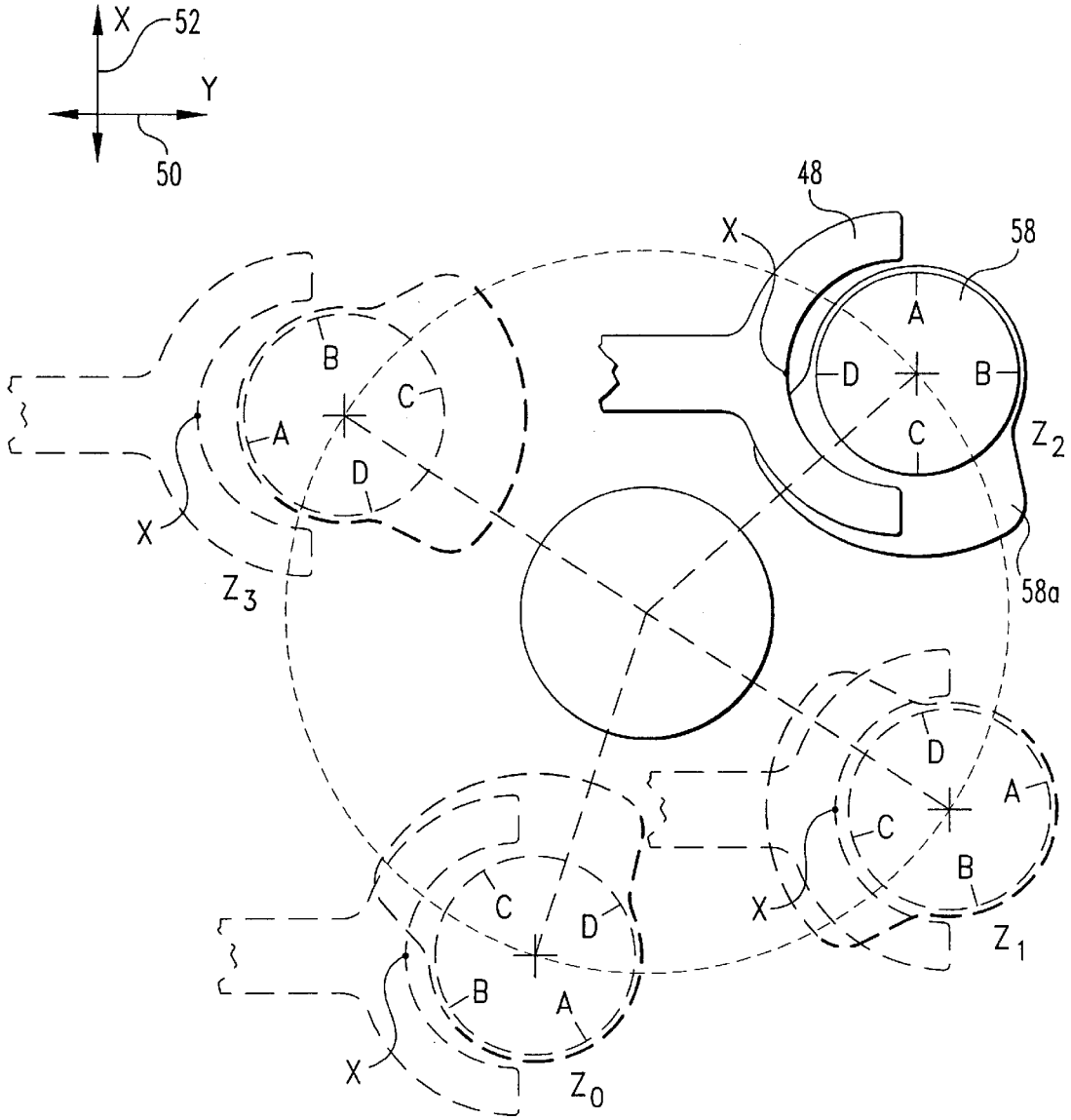
FIG. 7B is a diagrammatic illustration of the orientation of a crankshaft counterweight and the induction coil assembly during one revolution of the crankshaft according to one embodiment of the present invention.

In the FIG. 7B drawing, the location of the counterweight 58*a* relative to the coil assembly 48 is illustrated in four different positions ($Z_0$–$Z_3$) during one cycle. The positions of FIG. 7B correspond generally to the positions of FIG. 7A. At the $Z_1$ position, the coil portion is at its closest to the pin which generates the greatest amount of heat which compensates for the heat which is lost due to the counterweight acting as a heat sink. At the $Z_3$ position which is 180° from the $Z_1$ position, the coil portion is at its location of greatest separation from the pin. This is the position where the counterweight has the least effect, if any, on the heat reduction due to the counterweight acting as a heat sink.

As the crankshaft rotates and the pin 58 moves through position $Z_2$ from $Z_1$ to $Z_3$, the distance of separation between the inner surface 57 of the coil portion and the outside diameter surface of the pin increases. Then when returning from $Z_3$ to $Z_1$ through the $Z_0$ position, the distance of separation decreases.

If a point (X) is marked on the coil portion and its path is traced for one cycle, it will be seen that the tracking orbit is elliptical rather than circular.

In a still further embodiment of the present invention, the path of the coil portion of the coil assembly is circular, the rate of rotation is constant, and the separation distance remains constant. However, the power output (kW) of the power supply for the coil assembly is varied depending on the position of the crankshaft and accordingly depending on where the coil portion is positioned relative to the orientation of the pin and the counterweight location. The FIG. 7A drawing is suitable to diagrammatically illustrate the rotation of the pin and counterweight when the power output is varied. In the $Z_1$ position, the power output is the greatest due to the counterweight location. In the $Z_3$ position, the power output is the lowest due to the counterweight location. The power output decreases from $Z_1$ to $Z_3$ and then increases from $Z_3$ to $Z_1$. Whenever the coil is adjacent the counterweight side of the pin, the power output is increased so as to generate more heat and thereby compensate for the heat which is lost via the counterweight.

It is important to understand that the adjustments which are made by these alternative embodiments are all achievable with the same basic mechanical and electrical structures associated with apparatus 20. All of the adjustments are effected by changing the speed programming of the spindle motor and the tracking speed of the X and Y drive systems or by changing the X and Y travel to vary the spacing or by changing the power output from the power supply.

One important feature of the present invention is that the induction coil assembly is free of any direct physical contact with the crankshaft pin which is being inductively heated and quench hardened. The induction coil assembly is also free of any direct physical contract with all other orbiting features. Likewise, at the second apparatus, the corresponding induction coil assembly is free of any direct physical contact with the crankshaft bearing surface which is being inductively heated and quench hardened. This lack of any contact includes the lack of any sensor or position indicator riding on the surface of the corresponding pin or bearing surface. In this way the coil assembly is not subjected to wear which would significantly reduce or shorten the coil life. By designing an apparatus where there is no contact between the coil portion of the assembly and the surface or portion being induction hardened, coil portion wear is virtually eliminated and coil portion life is noticeably extended. Likewise, since all other portions of the induction coil assembly are free of any contact with the crankshaft portion being induction hardened, there is no wear to these portions and no shortened life. Some of the keys to the success of the present invention include the precise programming of the X and Y movement of the coil, based on the pin orbit and the open, semicylindrical design of the coil portion of the coil assembly. While a vertical crankshaft orientation is preferred, the suitability of the present invention is not limited to a vertical crankshaft. The present invention performs equally well for crankshafts which are horizontally supported between centers.

The first workstation 33 which has been described relative to the coil assembly travel and the induction hardening of the crankshaft pins has a design which is virtually duplicated by the second workstation. The second workstation 36 includes a virtually identical X-drive system 61, a virtually identical Y-drive system 62, the cooperating servo ball screw table set at ninety (90) degrees to each other, and an induction coil assembly 63 with an open, semicylindrical configuration which is virtually identical to coil assembly 48. The servomotor 45 functions in a virtually identical manner to motor 44 and controls the rotary motion of the corresponding crankshaft. As has been described, the two workstations 33 and 36 of apparatus 20 are constructed and arranged to be virtually identical so that two crankshafts may be processed concurrently, thereby doubling the through put rate. When both workstations 33 and 36 are designed for induction hardening of the crankshaft pins, their construction is virtually identical so that two crankshafts may be processed concurrently.

The primary difference between the first apparatus 20 and the second apparatus 30 is the difference between what portions of the crankshaft are being induction hardened at each apparatus location. At the first apparatus 20, the crankshaft pins are being induction hardened, while at the second apparatus (see FIGS. 8–11) the bearing surfaces are being induction hardened. Since the cylindrical bearing surfaces are coaxial with one another, are of the same cylindrical size, and are centered on the longitudinal axis of the crankshaft, the control of the movement of the bearing surface induction coil assemblies 64*a*–64*e* is less complex at the second apparatus 30. The foregoing comparison is applicable whether these two apparata include one, two, or some other number of virtually identical workstations.

With regard to the bearing surfaces 28*a*–28*e* which comprise a portion of the crankshaft 65, these surfaces, as indicated, have substantially the same outside diameter and cylindrical shape. Importantly, these cylindrical surfaces are concentric with the longitudinal axis of the crankshaft and accordingly concentric with the longitudinal axis extending between the two supporting centers. As illustrated, the upper center is preferably replaced with a positive lock (chuck). Consequently, because the bearing surfaces do not actually have their own unique orbit, the induction coil assemblies 64*a*–64*e* utilized at the workstations of the second apparatus 30 have a fixed position during the rotation of the crankshaft, once each coil assembly is initially set in its desired proximity to the corresponding bearing surface. There still needs to be some type of an X and Y positioning system to initially position each coil assembly adjacent the corresponding bearing surface, but once properly positioned, the induction coil assembly for the corresponding bearing surfaces does not have to be moved or traced in a particular or corresponding orbital path. This is obviously different for the pins due to their off-axis location relative to the crankshaft centerline.

To the extent that the crankshaft 65 can accept the amount of heat to be generated if more than one bearing surface is inductively heated simultaneously, it is possible to use a plurality of coil assemblies 64*a*–64*e* at the workstations of apparatus 30. The configuration of apparatus 30, as illustrated in FIGS. 8–11, includes a series of five induction coil assemblies 64*a*, 64*b*, 64*c*, 64*d* and 64*e*. The crankshaft 65 which is loaded into position between vertical centers 66*a* and 66*b* includes five bearing surfaces and the operation of apparatus 30 inductively heats three of the five bearing surfaces in one operational cycle and the remaining two bearing surfaces in a separate operational cycle (see FIGS. 12 and 13). As has been described, the upper center 66*a* is preferably a positive lock (chuck) of the style of chuck 40*b*. Each induction heating step is followed immediately by a quench step. Consistent with the foregoing descriptions, the quench fluid is delivered by way of the induction coils in one embodiment of the present invention. In an alternative embodiment, the quench fluid is delivered by a separate quench mechanism which does not utilize the induction coil assemblies as a delivery device.

Figure 8:
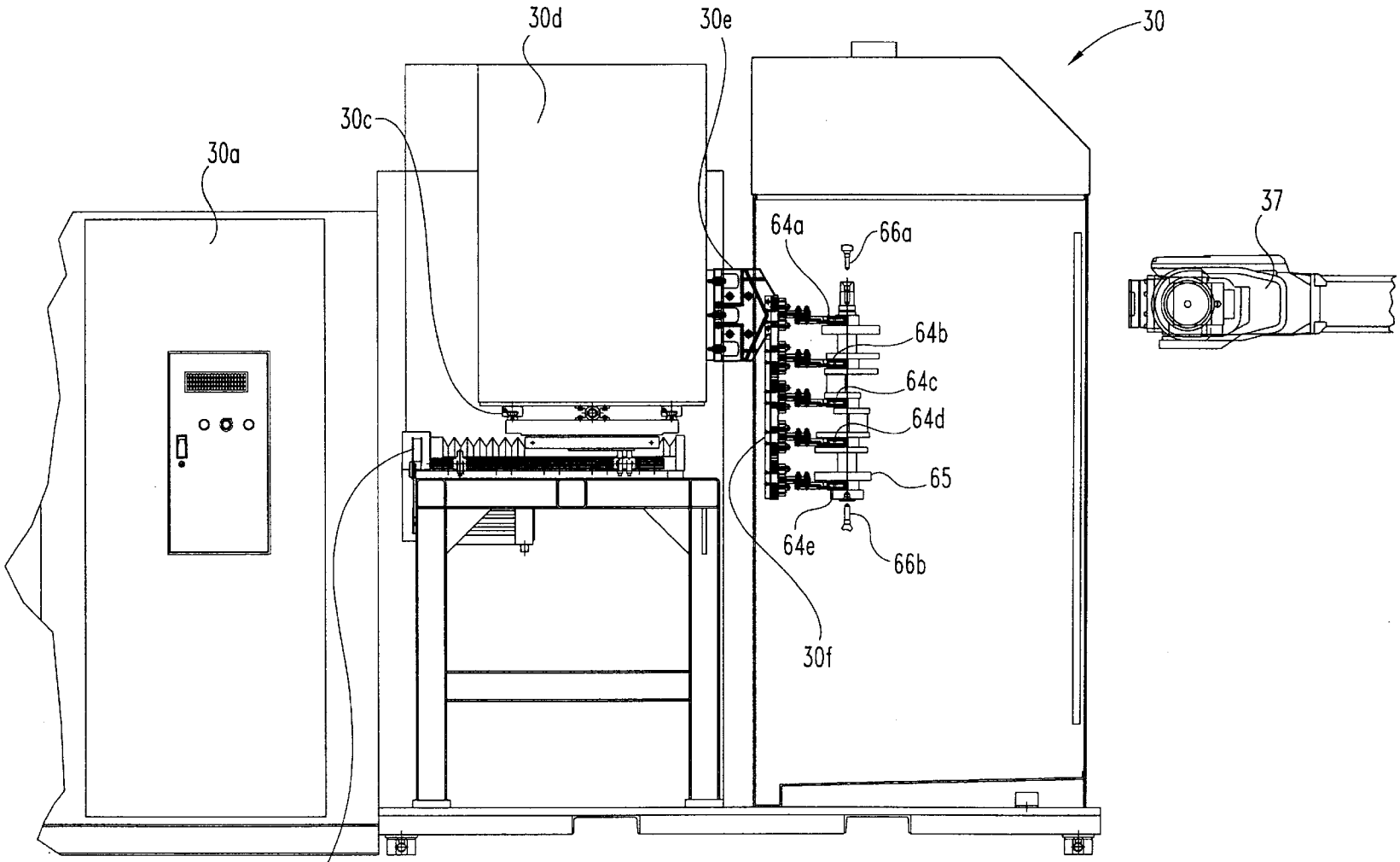
FIG. 8 is a side elevational view of an induction hardening apparatus for the bearing surfaces of a crankshaft according to a typical embodiment of the present invention.
Figure 12:
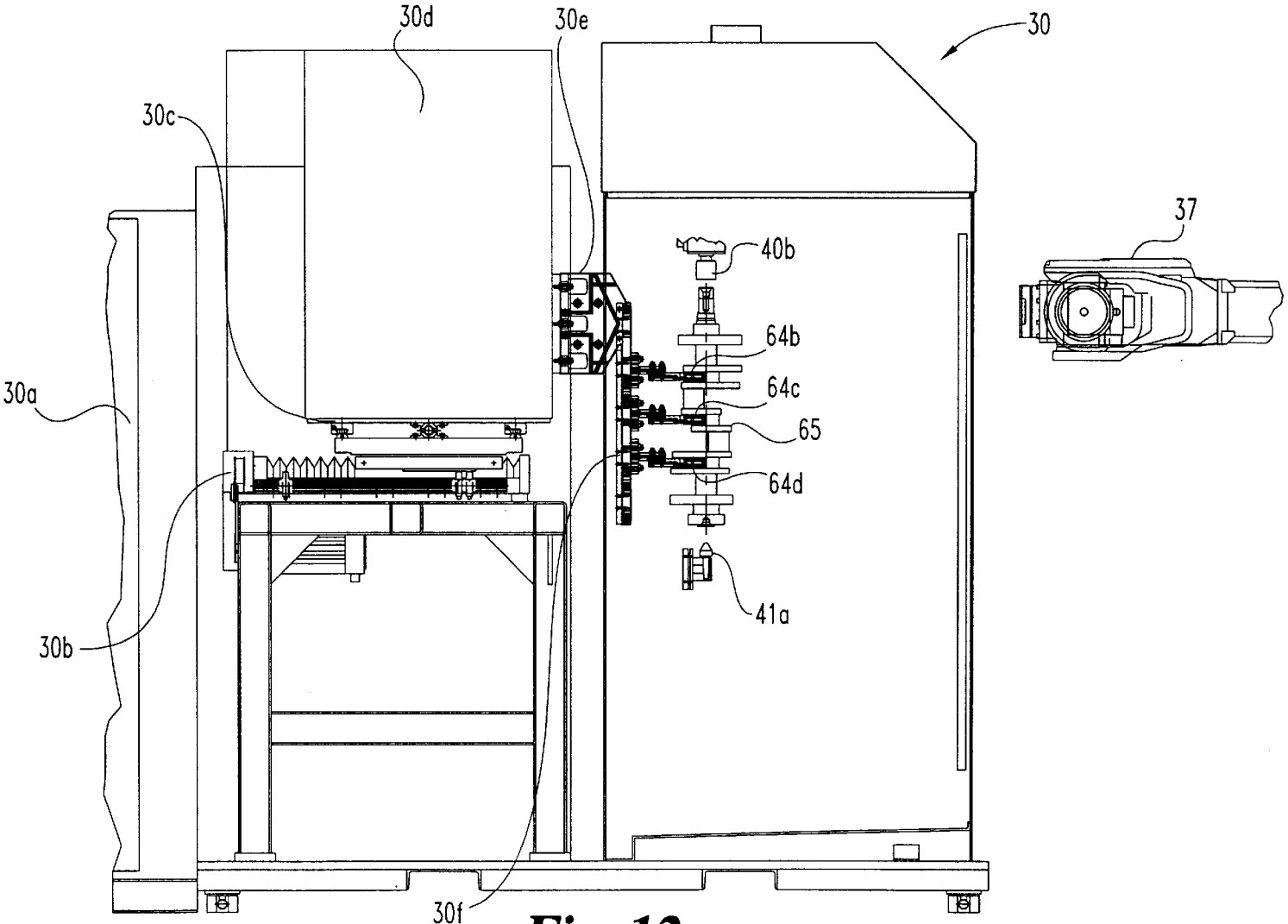
FIG. 12 is an enlarged side elevational view of the crankshaft to be induction hardened by the FIG. 8 induction hardening apparatus.

In the FIG. 8 illustration the five coil assemblies 64*a*–64*e* are each illustrated as they would be positioned relative to their corresponding bearing surfaces of crankshaft 65. This arrangement would be used if all five bearing surfaces were to be induction hardened simultaneously. However, since this would generate too much heat, FIGS. 12 and 13 illustrate how three coil assemblies are used first and then how two coil assemblies are used. The order may be reversed, but the point is that by simultaneously heating a fewer number of bearing surfaces, there is less heat generated and less distortion. Whether the two bearing surfaces are inductively heated and quench hardened before or after the other three bearing surfaces, the simultaneous processing of multiple bearing surfaces results in a faster overall completion cycle compared to the processing of one bearing surface at a time. Included as part of apparatus 30 is an inductive power supply 30*a*, a Y-axis drive system 30*b*, a slide rail 30*c*, a transformer assembly 30*d*, bus bar 30*e* and bus bar extension 30*f*. With the exception of the bus bar extension and the slide rail which replaces the X-axis drive system 51 of apparatus 20, apparatus 30 is virtually identical to apparatus 20.

Referring now to FIGS. 15, 16, and 17, a further embodiment of the present invention is diagrammatically illustrated. Apparatus 220 includes three horizontal positioning systems 221, 222, and 223, each of which are connected to a corresponding coil assembly for the pins or to a plurality of coil assemblies for the bearing surfaces. Each positioning system includes X-axis and Y-axis positioning systems which are fixed to each other at a 90 degree angle. For the bearing surfaces (systems 221 and 222), the X-axis positioning system is a manual slide device. Also illustrated is a separate heat station transformer 224, 225, and 226 located adjacent each horizontal positioning system. Apparatus 220 includes all of the standard system components, even though these are not illustrated. These standard system components are illustrated in other drawing figures and are excluded here simply for drawing clarity and due to the fact that the focus of the embodiment of FIGS. 15–17 is on the manner of combining into a single workstation induction hardening subsystems for both the pins and the bearing surfaces. Apparatus 220 further includes a common support system 227 for vertical travel along the Z-axis, an upper chuck 228 and a lower vertical support center 229.

While some of the components and features have been eliminated in some of the drawings simply for drawing clarity, a complete understanding of apparatus 220 can be gained by the following analysis. The construction of apparatus 220 can be appreciated by noting that positioning system 221 and transformer 224 are substantially the same as what is illustrated in FIG. 12 which controls three coil assemblies that are used to simultaneously induction harden three bearing surfaces. Positioning system 222 and transformer 225 are substantially the same as what is illustrated in FIG. 13 which controls two coil assemblies that are used to simultaneously induction harden two bearing surfaces. Positioning system 223 and transformer 226 are substantially the same as what is illustrated in FIG. 5 which controls one coil assembly that is used to sequentially induction harden the pins of crankshaft 230. The coil assemblies include assemblies 221*a*, 221*b*, and 221*c* for system 221, assemblies 222*a* and 222*b* for system 222, and assembly 223*a* for system 223.

In FIG. 16 the bearing surface coils 221*a*, 221*b*, 221*c*, 222*a*, and 222*b* are not illustrated nor is positioning system 223. In FIG. 17 positioning system 223 is illustrated but the two bearing surface positioning systems 221 and 222 are omitted for drawing clarity. The support arms 231 and 232 are configured the same as arms 40–43 as would be expected consistent with the description of FIGS. 15–17. In all respects the operation of apparatus 220 is the same as the operation of the corresponding portions of apparata 20 and 30. The differences include the use of a single vertical positioning system for the crankshaft in combination with horizontal (slide) positioning systems that position coils for both pins and bearing surfaces at the same single workstation.

It is also an option with the present invention to configure apparatus 20 and workstations 33 and 36 with multiple induction coil assemblies, each with its own servodrive system, its own X and Y drive systems, and control circuitry. This allows the simultaneous processing of multiple pins of one crankshaft. If two workstations are configured and utilized as part of apparatus 20, then each workstation can be configured with multiple induction coil assemblies for the crankshaft pins.

Figure 2A:
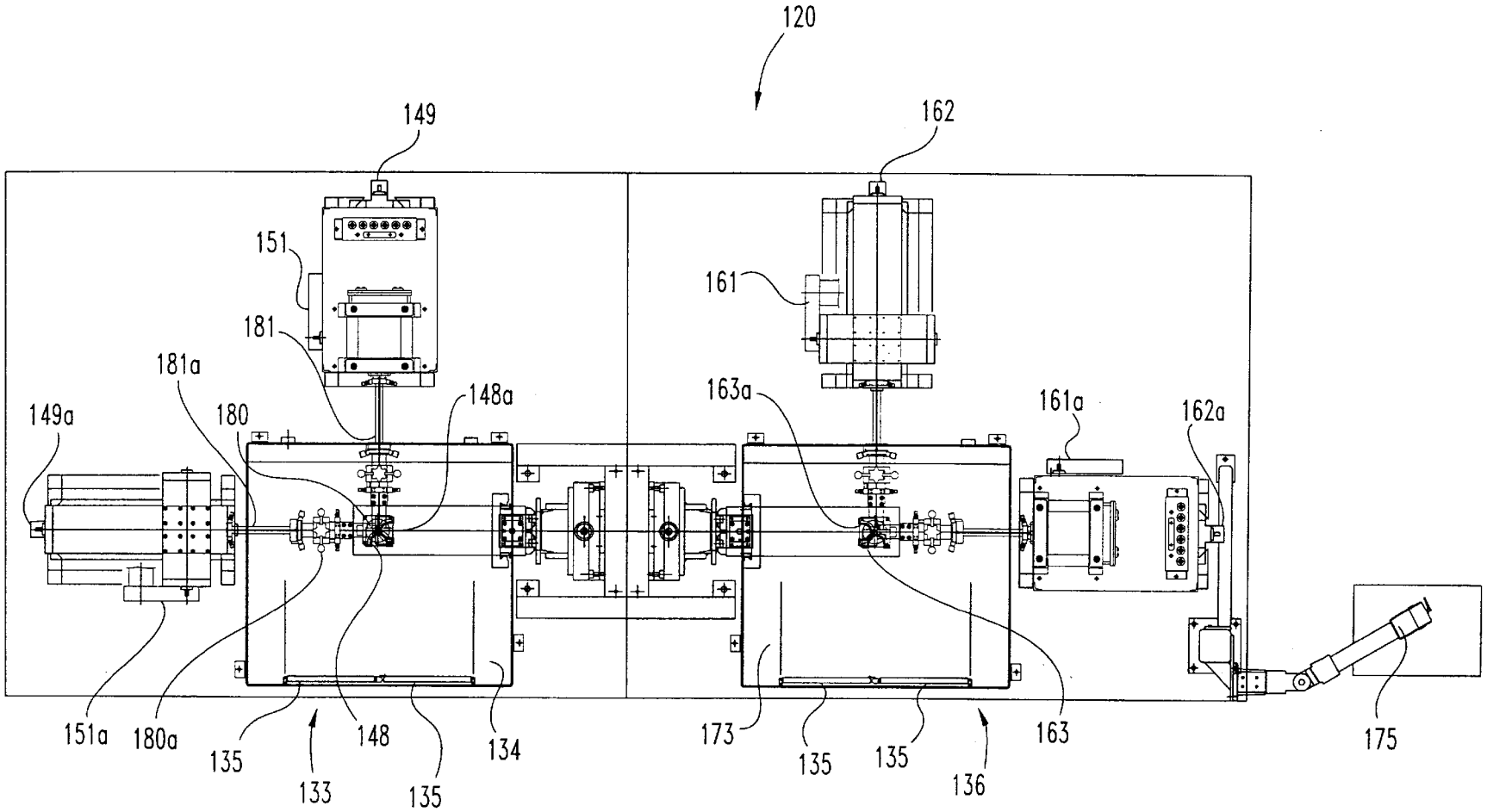
FIG. 2A is a top plan view of an induction hardening apparatus according to an alternate embodiment of the present invention.
Figure 3A:
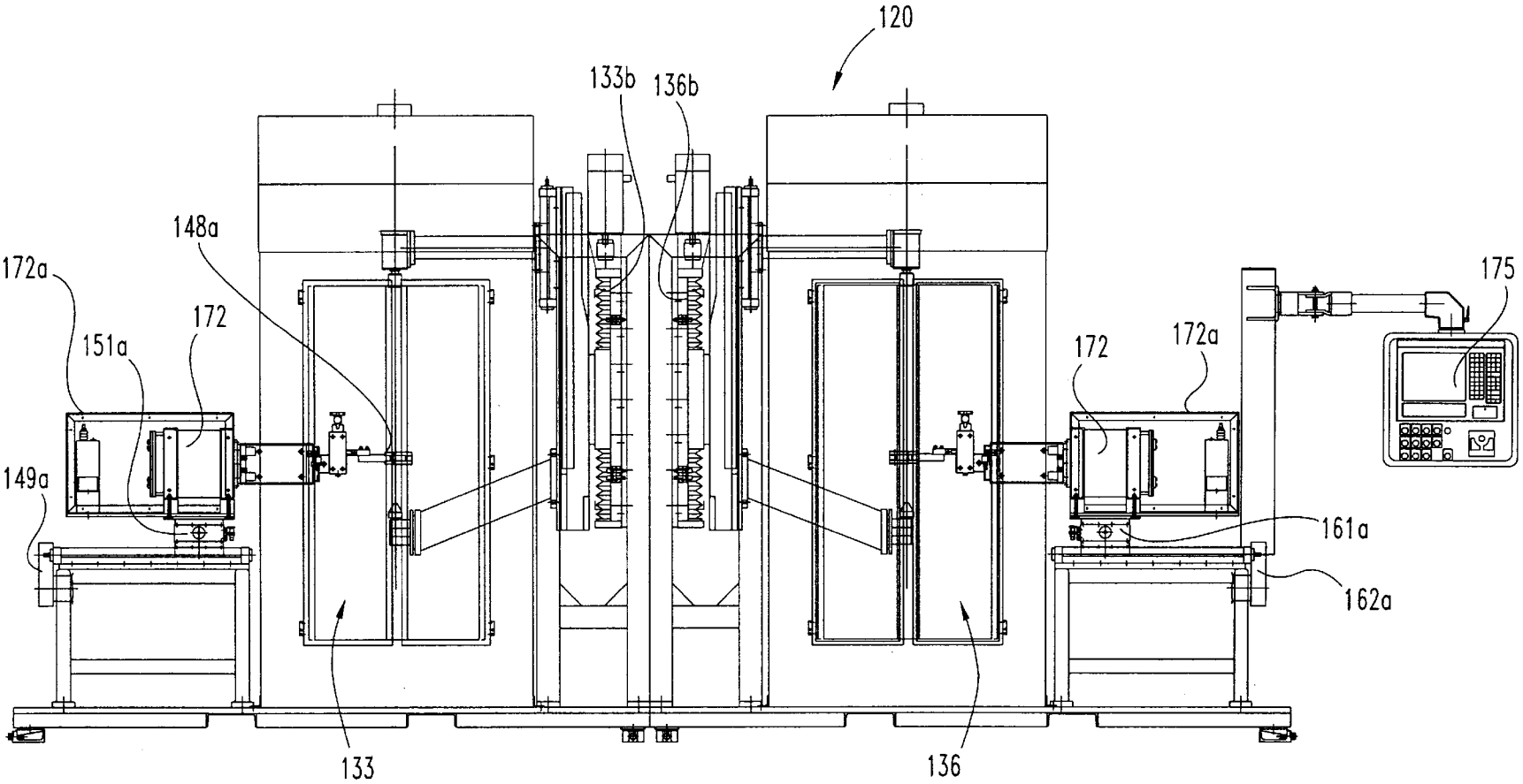
FIG. 3A is a front elevational view of the FIG. 2A induction hardening apparatus.
Figure 4:
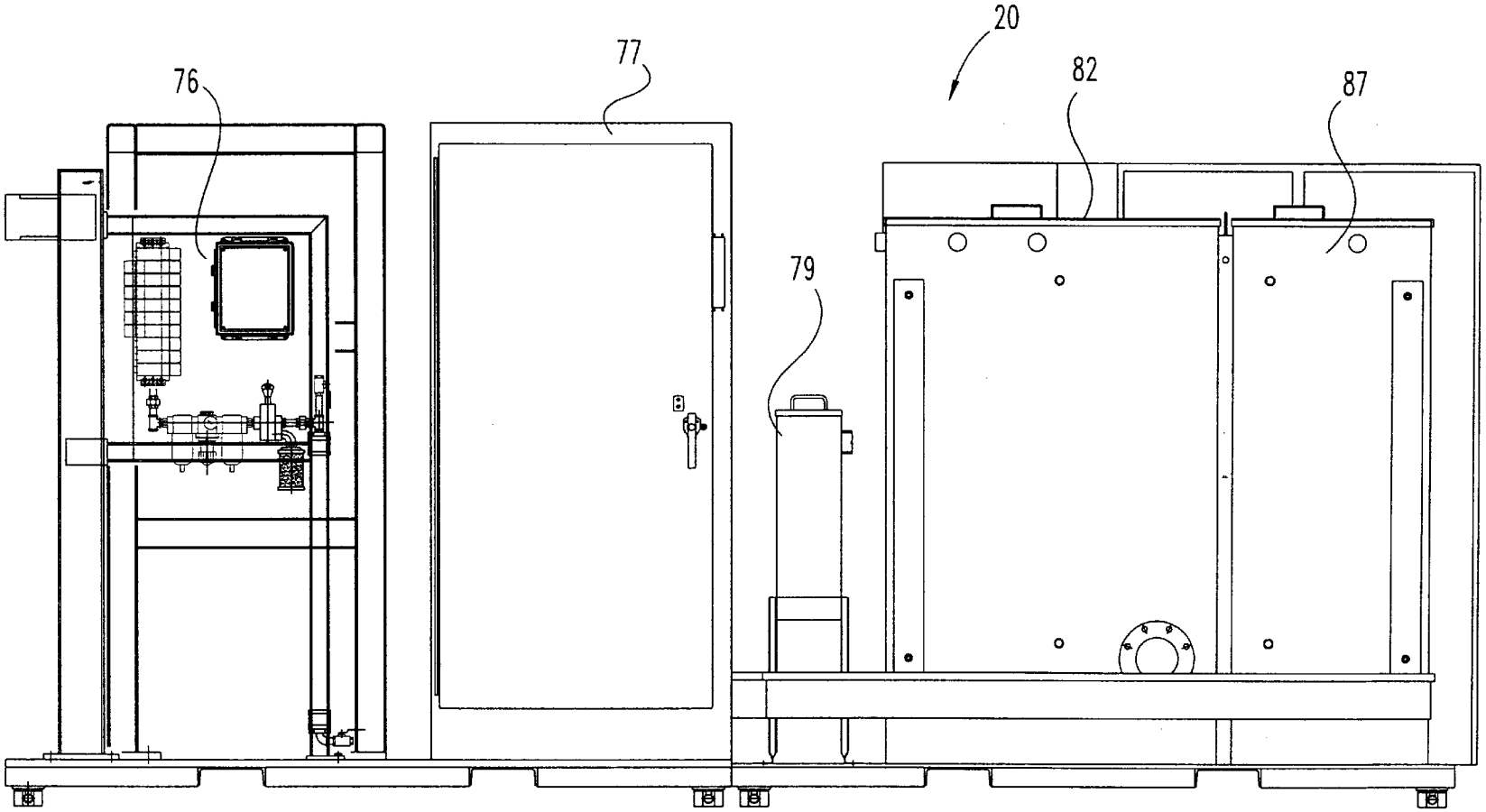
FIG. 4 is a right side elevational view of the FIG. 1 induction hardening apparatus.

Referring now to FIGS. 2A and 3A, apparatus 120 is illustrated with workstations 133 and 136. In view of the fact that apparatus 120 is virtually identical to apparatus 20, though with the addition of a second coil assembly and cooperating drive systems, the corresponding reference numerals have been given a 100 number prefix. Accordingly, workstation 133 is intended to be virtually identical to workstation 33 and similarly, workstation 136 is intended to be virtually identical to workstation 36.

One of the differences between apparatus 20 and apparatus 120 includes the relocating of the vertical position portions 133*b* and 136*b* (33*b* and 36*b* for the two workstations 33 and 36), respectively, to the space between the two workstations 133 and 136. This makes the left side of one workstation 133 and the right side of the other workstation 136 open so that second X and Y drive systems 151*a* and 149*a* and 161*a* and 162*a*, respectively, can be installed as illustrated in FIGS. 2A and 3A. The second X-Y drive arrangement at workstation 133 is virtually identical to the arrangement of the X-drive system 151 and the Y-drive system 149. Likewise the second X-Y drive arrangement at workstation 136 is virtually identical to the arrangement of the X-drive system 161 and the Y-drive system 162. With regard to the four X-Y drive arrangements which are illustrated, each one includes an X-axis drive system, a Y-axis drive system, a transformer, and a transformer housing. In order to illustrate all of these component parts, the drawings have been diagrammatically adjusted to remove the transformer from two locations to better show the X and Y drives.

Like the first X-Y drive arrangement located at workstation 133, the second X-Y drive arrangement is connected to an induction coil assembly 148*a* via a bus bar 181*a* and quick-change device 180*a*. The first X-Y drive arrangement is connected to coil assembly 148 via bus bar 181 and quick-change device 180. By providing a second induction coil assembly 148*a* with all of the cooperating structures and drive systems, at each workstation, two pins can be induction hardened simultaneously. In order to distribute the heat, pins 27*a* and 27*c* (1st and 3rd pins) are induction hardened during the first cycle. Thereafter, pins 27*b* and 27*d* (2nd and 4th pins) are induction hardened during the second cycle. By doubling the number of induction coil assemblies, the induction hardening cycle time for the pins of the crankshaft is cut in half.

Additional components and systems illustrated in FIGS. 2A and 3A which have counterparts in FIGS. 1, 2, 3, 4, 5, and 6 include the human/machine interface 175, induction coil assemblies 163 and 163*a*, doors 135, enclosure 173, transformer 172, transformer housing 172*a*, and enclosure 134.

Depending on the specific crankshaft design and the various cycle times, the use of multiple coil assemblies at each workstation and the use of multiple workstations may be more advantageous for some crankshaft designs than for others. The planning of the design of each apparatus, including the number of workstations and the design of each workstation, should be performed with an appreciation of the type of crankshafts to be run so that the cycling of the crankshafts from apparatus to apparatus is efficient and cost effective.

Another factor to consider is the tolerances to be maintained. If a plurality of bearing surfaces are induction hardened simultaneously, there could be some slight distortion requiring a subsequent grinding operation. There is not a distortion concern when only one pin at a time is induction hardened. For this reason, one might want to complete the induction hardening of all bearing surfaces and bring the crankshaft back into tolerance before initiating the induction hardening of the crankshaft pins.

With continued reference to FIGS. 1, 2, 3, 4, 5, and 6, some of the standard system components associated with each apparatus are illustrated. Induction hardening apparatus 20 includes for the first workstation 33 a 300 kW/10 kHz inductive power supply 67 and a compound precision horizontal slide 68 providing the X and Y drive systems 51 and 49, respectively. Duplicate equipment is provided for the second workstation 36 including inductive power supply 69 and horizontal slide 70. Slide 70 provides X and Y drive systems 61 and 62. Each workstation 33 and 36 also includes a heat station transformer 72 and transformer housing 72*a*. Enclosures 34 and 73 are provided to enclose the crankshafts and coils at each workstation. Apparatus 20 includes certain components and systems which interface with both workstations including human/machine interface 75, various pneumatics and controls 76, a main control enclosure 77, positioning control enclosure 77*a*, and a fluids system 78. Also included is a quench filter 79, quick change device 80 for each coil assembly, and bus bar 81. The main control enclosure 77 includes the computer and PLC controls, logic circuitry, running controls, breakers, and input/output circuitry for the apparatus. Enclosure 77*a* includes the circuitry for the positioning control devices.

With specific reference to FIG. 2, an 800 gallon quench water tank 82 is flow coupled to two 15 HP quench pumps 83 and 84. Pump 83 is coupled by a flow line to the first workstation 33 while pump 84 is coupled to the second workstation 36. Return lines 85 and 86 return the quench water which is used at each workstation and collected back into the quench water tank 82. Distilled water tank 87 contains a supply of distilled water for cooling of the electrical components. Pump 88 is used to deliver distilled water from tank 87. Pump 89 is a recirculating pump for cooling purposes only. Each induction coil assembly 48 and 63, in one embodiment of the present invention, is configured with a series of flow openings positioned around its inner surface for the rapid delivery of quench water to the inductively heated portions of the crankshaft, whether those portions include a pin or bearing surface (see FIG. 6A). By configuring the coil assemblies with a quench capability, there is no need to move the induction coil assembly and either position the crankshaft at a quench station or move a separate quench system into position. The combining of the inductive heating and quench hardening steps in a single coil assembly is one option for the present invention. Additionally, the use of a separate quench system is contemplated as a very viable part of the present invention due to the availability of excellent quench system technology. The use of a separate quench system is beneficial whenever the coil assembly design is to be simplified or when there is a desire to shorten the cycle time.

As has been described, the quench capability or function is performed in one embodiment of the present invention by flow holes machined directly into the induction coil assembly. These flow holes are connected to flow lines which are connected to the corresponding quench pump, see FIG. 2. In the alternative embodiment when a separate quench mechanism is used, the same flow lines are connected to the quench mechanism.

The actual quench step is preferably performed in stages. The first stage is while the crankshaft is still rotating immediately after the pin or bearing surface has been raised to the desired temperature. When a secondary or supplemental quench is performed, this occurs at a different Z-axis location and requires a vertical shift of the crankshaft. While the supplemental quench is being performed, the next pin is able to be positioned relative to the induction coil assembly for processing. This doubling up of different functions helps to reduce the overall cycle time for the crankshaft.

Figure 9:
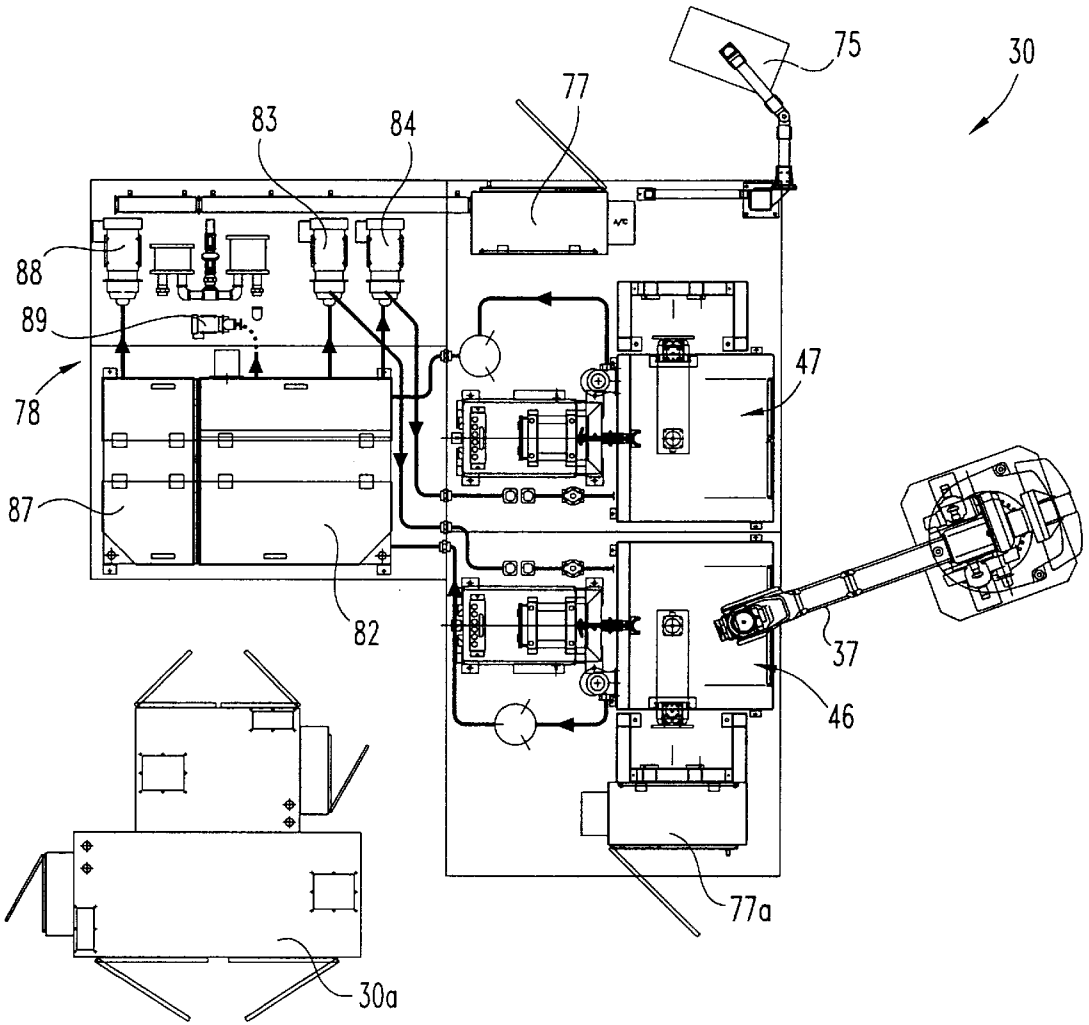
FIG. 9 is a top plan view of the FIG. 8 induction hardening apparatus.
Figure 10:
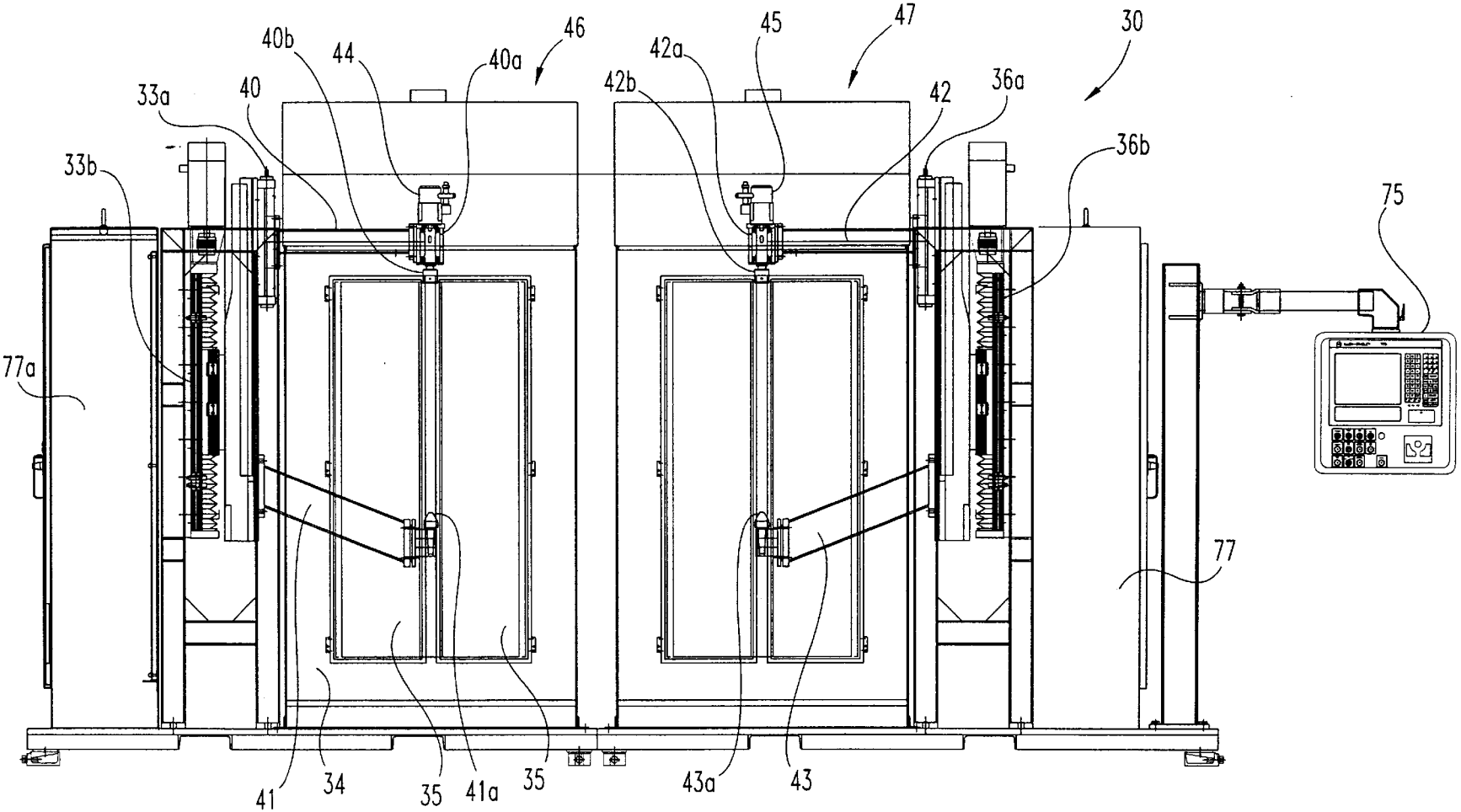
FIG. 10 is a front elevational view of the FIG. 8 induction hardening apparatus.
Figure 11:
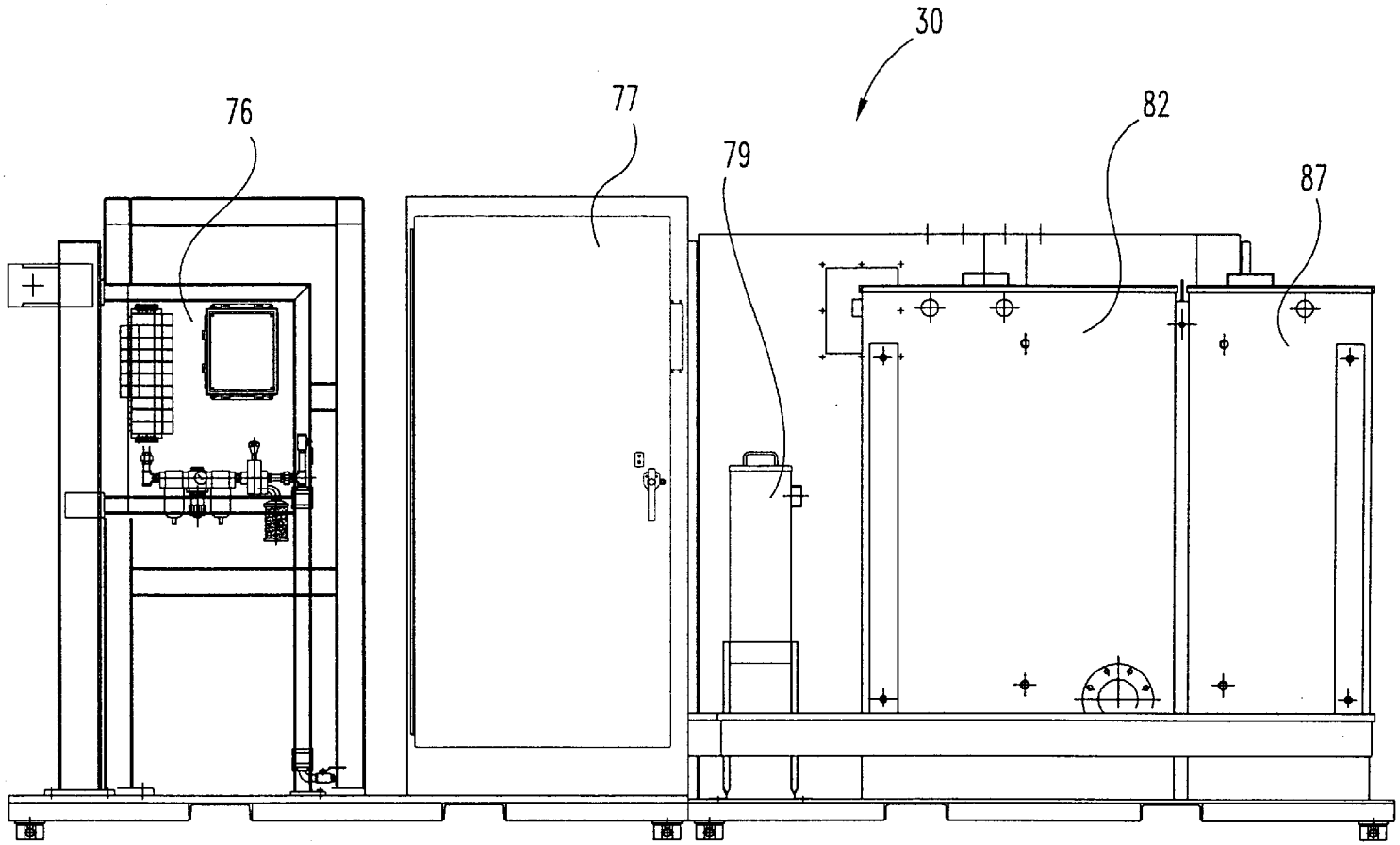
FIG. 11 is a right side elevational view of the FIG. 8 induction hardening apparatus.

The system layout of FIG. 2 for apparatus 20 is virtually duplicated by the system layout for apparatus 30 as illustrated in FIG. 9. Accordingly, the same reference numbers have been used in order to identify components and/or subsystems which are virtually identical in apparata 20 and 30. The principal difference between apparata 20 and 30 is in the X and Y drive systems due to the induction hardening of pins via apparatus 20 and the induction hardening of bearing surfaces via apparatus 30.

With a single coil assembly at each workstation, the inductive heating and quench hardening steps are sequential, one pin or one group of bearing surfaces at a time. Once the crankshaft is vertically supported between centers at the first workstation 33, the induction coil assembly 48 is moved into position and as the crankshaft rotates, the coil assembly 48 generally tracks the orbit of the selected pin at the same rate and inductively heats the pin. This heating step takes approximately 10–20 seconds. Once the pin of the crankshaft is heated to the desired temperature, the quench step needs to be performed. This is achieved in one embodiment by a surge of quench water through the coil assembly and directly onto the pin which has been heated (see FIG. 6A). In another embodiment of the present invention, the coil assembly is disengaged and the crankshaft continues to rotate while a separate quench station is operated. The crankshaft continues to rotate while the quench step is being performed regardless of the embodiment. Once the induction hardening of this first pin is completed, the crankshaft is vertically indexed while the coil assembly remains fixed in order to position to the next pin of the crankshaft. This procedure is repeated until all of the pins of the crankshaft have been inductively heated and quench hardened. The drive systems for the coil assembly are programmed to recognize which pin is selected and the X and Y drive systems are programmed to trace a preselected orbit for that particular pin. Since various embodiments have been described, it must be determined whether any counterweight adjustment is desired and, if so, which type of adjustment will be made. The X and Y travel of the coil assembly is still the same for each pin, once the starting position is determined. Each pin has a different circumferential location relative to the rotary position of the crankshaft and thus the starting position of the coil assembly varies depending on the selected pin.

The induction coil assembly 48 at the first workstation 33 is initially positioned relative to the selected pin prior to rotation of the crankshaft. Accordingly the X-Y tracking path for the coil assembly of the pin orbit needs to have a tracking speed which is synchronized with the speed of the crank-shaft. The speed and path of the coil assembly are critical and must precisely match the speed of the crankshaft and the orbit of the pin. Even when the spacing between the coil assembly and the pin varies, there is still a specific tracking orbit which is traced each cycle. This is not a concern for the bearing surfaces due to the coaxial nature of their orbit.

As has been explained, the induction hardening of the crankshaft pins can be completed prior to the induction hardening of the bearing surfaces or after the induction hardening of all bearing surfaces. The pins and bearing surfaces can be processed at two different workstations as part of one apparatus or by two separate apparata, one dedicated to pins and the other dedicated to bearing surfaces.

Figure 6A:
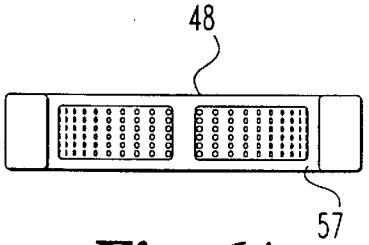
FIG. 6A is a front elevational view of the FIG. 6 induction coil assembly.

As illustrated in FIGS. 5 and 6, a typical coil assembly includes a copper heating element (inductor) 93, an internal cooling jacket 94, a field focusing portion 95 of iron suspended plastic material, isolation spacer 96, and a locator block 97. The field focusing portion is used to manipulate the magnetic flux field. When the quench capability is built into the coil assembly, the inner surface 57 is provided with a plurality of holes in a compact and uniform pattern as illustrated in FIG. 6A. When the quench function is performed by a separate quench mechanism, the quench mechanism is located between the ends of the crankshaft on a positioning mechanism (not illustrated) as is well known in the art.

The programming logic for the present invention which is discussed below is intended to apply to the induction hardening of the pins of the crankshaft and not for the bearing surfaces. This is due to the type of rotational orbit which the pins have relative to the longitudinal axis of the crankshaft as contrasted to the concentric or coaxial location of the bearing surfaces relative to the crankshaft axis. The first item of data to be provided is the engagement position for both the X and Y drive systems so that the corresponding induction coil assembly is properly positioned relative to the corresponding pin which is to be inductively heated and quench hardened. The additional data which will be programmed into the computer control or logic circuit is derived from the particular crankshaft specifications. This data involves the size, shape, and geometry of the crankshaft, including the pins and any counterweights. The required data is entered by way of a keyboard (manual entry). Once the basic part specification data is entered, this will not change and it will be the same regardless of which pin of the crankshaft is being inductively heated and quench hardened. It is to be noted that the engagement position may or may not change, depending on how well the particular crankshaft has been manufactured relative to its design dimensions and tolerances. Additional data or information which the operator can input into the programming logic for the present invention by way of the keyboard includes the tolerances per pin, the number of revolutions, the spin time, the heat time, the spin speed and the power supply output. The spin speed in RPMs during heating is currently set so that there are two RPMs, one per hemisphere. In one hemisphere, the shaft is spinning at 30 RPMs and in another, it is spinning at 50 RPMs. This could be subdivided down into quarters or even smaller sections. It should be understood that the rotational speed can be broken down into smaller increments, allowing a gradual acceleration and/or gradual deceleration as described herein. It is also to be noted that the present invention must be pre-programmed to follow either a circular path or an elliptical path, depending on how one wants to concentrate the heat from the induction coil assembly. These various path options are discussed herein with regard to the alternative embodiments of the present invention. As will be understood, when a circular orbit is being tracked by the induction coil assembly, the X axis drive system follows a cosine wave form and the Y axis drive system follows a sine wave.

With regard to utilization of apparatus 20 consistent with the present invention, the process begins by the robot and/or operator putting the crankshaft on the lower center support and then clamping or chucking onto it at the top in order to start the cycle. The X and Y directions are horizontal and, as described, these two drive systems are connected to each other at 90°. The rotational motion referred to as theta (θ) defines the motion of the drive spindle/crankshaft. The Z axis is in the vertical direction and represents the positioning axis for the induction coil assemblies and the crankshaft in a vertical direction.

The first step involves movement in the direction of the Z axis by the crankshaft moving into a position where the pin that is selected for induction heating is placed in a "known" location which is referred to as zero degrees theta (θ). Once the pin of the crankshaft is moved to the desired vertical location, the crankshaft is rotated until the theta (θ) reading is 0 degrees based on the input from a photosensor switch. Once the theta (θ) position of 0 degrees is determined, the system moves the crankshaft along the Z axis (vertical) down into the coil position, which is the position that is going to inductively heat that particular pin. Once the Z axis and theta (θ) locations are properly set, then the X-axis drive system is engaged so as to move the induction coil assembly to its engagement point which will line up with the corresponding pin of the crankshaft. Next, the Y-axis drive system is engaged so as to move the induction coil assembly into the crankshaft. As represented on the corresponding drawings, when looking directly into the front of the machine (see FIG. 3), the X-axis direction is left and right and the Y axis direction is into and out of the machine. Accordingly, once the X and Y positions are established and the crankshaft is sitting at zero degrees theta (θ), the system starts spinning (in the theta (θ) direction), going in a counterclockwise direction. After the spinning motion starts in the theta (θ) direction, the X and Y drive systems follow, tracking the particular orbit for that pin, making a corresponding counterclockwise path. While a counterclockwise direction has been selected, it should be noted that the theta (θ) direction can be either clockwise or counterclockwise.

It is also to be noted that there is a disengagement position which is the position of theta (θ) in degrees where it is possible to disengage the X and Y drive systems safely, extracting the induction coil assembly from its relationship to the crankshaft without "crashing" the machine. As the crankshaft is spinning in a counterclockwise, theta (θ) direction, it is going from a zero degree location reading all the way around to a 360 degree location. At the present time, the disengagement position is programmed at approximately 240 degrees. What actually occurs is that the induction coil assembly rotates out of engagement much like gears rotating out of a meshed relationship to one another. The particular disengagement position is based on the part specifications and thus, as the parts change, the disengagement point may also change. However, the disengagement position will generally be in the third quadrant of the circular path of the corresponding crankshaft pin.

Once the induction heating cycle is complete, the controller, which in the case of the present invention is an Allen Bradley Slick 500, will actually indicate that the heating phase has been completed. At this point, the X and Y drives control the disengagement of the induction heating coil, which at the present time is 240 degrees theta (θ). In performing the disengagement, the Y axis direction of movement is initially activated so as to back out the coil from its heating position. The X axis will actually stay engaged in order to follow the part so that it does not hit the sides of the coil. Once the Y travel gets approximately 3 inches outside of the programmed axis, it is possible to disengage the X axis drive system and thereby stop X from moving. At this point, the X and Y drive systems return to the home position or loading position for the next pin. It is to be noted that the coil assembly is disengaged from the crankshaft while the crankshaft continues to rotate. This particular disengagement protocol permits the crankshaft to spin during the quench cycle while the coil is disengaged. This particular protocol permits shorter cycle times and uniform quenching. In effect what can be done is to disengage the coil and lower the crankshaft in the Z axis direction and continue with a supplemental quench at that point while the next pin of the crankshaft is positioned for induction hardening. This allows the next pin to be placed in the ready position while the quench cycle for the prior pin is continuing. As indicated, this permits shorter cycle times while not adversely affecting uniform quenching.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, rotary drive means for rotating said crankshaft, a moveable induction coil which is constructed and arranged to inductively harden one pin at a time and a positioning system for moving said induction coil in a predetermined path which tracks the path of said one pin as said crankshaft is rotated, said positioning system maintaining a substantially uniform distance of separation between an inside surface of said induction coil and an outer surface of said one pin, during crankshaft rotation.

2. The combination of claim 1 wherein said second workstation includes fixture means for positioning and supporting said crankshaft at a crankshaft location, rotary drive means for rotating said crankshaft, a moveable induction coil which is constructed and arranged to inductively harden a selected bearing surface of said crankshaft and a positioning system for initially positioning said induction coil adjacent said selected bearing surface, said positioning system maintaining a substantially uniform distance of separation between an inside surface of said induction coil and an outer surface of said selected bearing surface during crankshaft rotation.

3. The combination of claim 2 wherein each of said induction coils associated with said first and second workstations has an open, semicylindrical shape.

4. The combination of claim 3 wherein each positioning system associated with said first and second workstations includes X and Y drive systems arranged relative to each other at a right angle.

5. The combination of claim 4 wherein each fixture means associated with said first and second workstations includes a pair of oppositely-disposed center supports for positioning and supporting said crankshaft.

6. The combination of claim 2 wherein said first workstation includes control means for generating coil path data based upon the geometry and dimensions of a selected pin of said crankshaft to be induction hardened, said control means being operatively connected to said positioning system of said first workstation.

7. The combination of claim 1 wherein said first workstation includes control means for generating coil path data based upon the geometry and dimensions of a selected pin of said crankshaft to be induction hardened, said control means being operatively connected to said positioning system of said first workstation.

8. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, rotary drive means for rotating said crankshaft, a moveable induction coil which is constructed and arranged to inductively harden one pin at a time and a positioning system for moving said induction coil in a predetermined path which tracks the path of said one pin as said crankshaft is rotated, said predetermined path having a variable distance of separation between an inside surface of said induction coil and an outer surface of said one pin, during crankshaft rotation.

9. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, rotary drive means for rotating said crankshaft, a plurality of moveable induction coils, each induction coil of said plurality being constructed and arranged to inductively harden a corresponding pin, and a positioning system for moving each induction coil in a predetermined path which tracks the path of said corresponding pin as said crankshaft is rotated, said positioning system maintaining a substantially uniform distance of separation between an inside surface of each induction coil and an outer surface of said corresponding pin, during crankshaft rotation.

10. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, drive means for moving said crankshaft in a desired path, a moveable induction coil which is constructed and arranged to inductively harden one pin at a time and a positioning system for moving said induction coil in a predetermined path which tracks the path of said one pin as said crankshaft is rotated, said positioning system maintaining a substantially uniform distance of separation between an inside surface of said induction coil and an outer surface of said one pin, during crankshaft rotation.

11. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, drive means for moving said crankshaft in a desired path, a plurality of moveable induction coils, each induction coil of said plurality being constructed and arranged to inductively harden a corresponding pin, and a positioning system for moving each induction coil in a predetermined path which tracks the path of said corresponding pin as said crankshaft is rotated, said positioning system maintaining a substantially uniform distance of separation between an inside surface of each induction coil and an outer surface of said corresponding pin, during crankshaft rotation.

12. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, rotary drive means for rotating said crankshaft, a moveable plurality of induction coils, each induction coil of said plurality being constructed and arranged to inductively harden a corresponding pin, and a positioning system for moving each induction coil in a predetermined path which tracks the path of said corresponding pin as said crankshaft is rotated, said predetermined path having a variable distance of separation between an inside surface of each induction coil and an outer surface of said corresponding pin, during crankshaft rotation.

13. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, drive means for moving said crankshaft in a desired path, a moveable induction coil which is constructed and arranged to inductively harden one pin at a time and a positioning system for moving said induction coil in a predetermined path which tracks the path of said one pin as said crankshaft is rotated, said predetermined path having a variable distance of separation between an inside surface of said induction coil and an outer surface of said one pin, during crankshaft rotation.

14. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening of said plurality of substantially cylindrical pins;

a second workstation for induction hardening of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, drive means for moving said crankshaft in a desired path, a plurality of moveable induction coils, each induction coil of said plurality being constructed and arranged to inductively harden a corresponding pin, and a positioning system for moving each induction coil in a predetermined path which tracks the path of said corresponding pin as said crankshaft is rotated, said predetermined path having a variable distance of separation between an inside surface of each induction coil and an outer surface of said corresponding pin, during crankshaft rotation.

15. In combination:

a crankshaft including a plurality of substantially cylindrical pins and a plurality of substantially cylindrical bearing surfaces which are in alternating sequence with said substantially cylindrical pins; and an induction hardening apparatus for inductively heating and quench hardening said crankshaft, said induction hardening apparatus comprising:

a first workstation for induction hardening at least one pin of said plurality of substantially cylindrical pins;

a second workstation for induction hardening at least one bearing surface of said plurality of substantially cylindrical bearing surfaces;

a robotic device constructed and arranged for moving said crankshaft from said first workstation to said second workstation; and said first workstation including fixture means for positioning and supporting said crankshaft at a crankshaft location, rotary drive means for rotating said crankshaft, a moveable induction coil which is constructed and arranged to be moved to an induction heating position relative to said at least one pin for inductively hardening said at least one pin and a positioning system for moving said induction coil in a predetermined path which tracks the path of said at least one pin as said crankshaft is rotated, said positioning system maintaining a distance of separation between an inside surface of said induction coil and an outer surface of said at least one pin, during crankshaft rotation, said positioning system including extraction means for moving the induction coil out of said induction heating position while said crankshaft continues to rotate.

* * * * *